US008942068B2

(12) United States Patent
Fujisawa

(10) Patent No.: US 8,942,068 B2
(45) **Date of Patent: *Jan. 27, 2015**

(54) TIMEPIECE WITH INTERNAL ANTENNA

(71) Applicant: Seiko Epson Corporation, Tokyo (JP)

(72) Inventor: Teruhiko Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/263,434

(22) Filed: Apr. 28, 2014

(65) Prior Publication Data

US 2014/0233358 A1 Aug. 21, 2014

Related U.S. Application Data

(63) Continuation of application No. 14/033,780, filed on Sep. 23, 2013, now Pat. No. 8,755,253, which is a continuation of application No. 13/875,520, filed on May 2, 2013, now Pat. No. 8,570,840, which is a continuation of application No. 12/871,483, filed on Aug. 30, 2010, now Pat. No. 8,467,272.

(30) Foreign Application Priority Data

Sep. 1, 2009 (JP) ..... 2009-201557
Jun. 24, 2010 (JP) ..... 2010-143886

(51) Int. Cl.
*G04C 11/02* (2006.01)
*G04R 60/10* (2013.01)
(Continued)

(52) U.S. Cl.
CPC ..... *G04R 60/10* (2013.01); *G04G 5/002* (2013.01); *G04G 9/0076* (2013.01); *G04G 21/04* (2013.01);
(Continued)

(58) Field of Classification Search
USPC ..... 368/46, 47, 64, 76, 14, 10, 13, 185, 55, 368/276, 278; 343/718, 702, 846, 848, 720
See application file for complete search history.

(56) References Cited

U.S. PATENT DOCUMENTS 6,094,404 A 7/2000 Hidai et al.
6,411,569 B1 6/2002 Megner et al.
(Continued)

FOREIGN PATENT DOCUMENTS

EP 0564236 A2 10/1993
EP 1522908 A1 4/2005
(Continued)

OTHER PUBLICATIONS

Office Action, U.S. Appl. No. 12/580,553 dated May 18, 2012.
(Continued)

*Primary Examiner* — Edwin A. Leon

(57) ABSTRACT

A timepiece includes a case; a dial made from a nonconductive material; a solar panel that has an opening and is disposed at a side opposite of a display side of the dial, the solar panel receiving light incident from the display side of the dial; a patch antenna disposed (i) at a side opposite a light receiving side of the solar panel, and (ii) at a position overlapping the opening in plan view; and a date wheel made from a nonconductive material that is disposed between the solar panel and the patch antenna in lateral view, and is disposed at a position overlapping, at least in part, the patch antenna in plan view. The dial has a date window for exposing at least part of the date wheel, and the date window is formed at a position overlapping the opening in plan view.

11 Claims, 17 Drawing Sheets

(51) Int. Cl.

| | |
|---|---|
| ***G04G 5/00*** | (2013.01) |
| ***G04G 9/00*** | (2006.01) |
| ***G04G 21/04*** | (2013.01) |
| ***H01Q 1/27*** | (2006.01) |
| ***H01Q 1/52*** | (2006.01) |
| ***H01Q 9/04*** | (2006.01) |
| ***G04R 60/12*** | (2013.01) |
| ***G04R 20/04*** | (2013.01) |
| ***G04C 9/00*** | (2006.01) |
| ***G04C 10/02*** | (2006.01) |

(52) U.S. Cl.

CPC ..... *H01Q 1/273* (2013.01); *H01Q 1/52* (2013.01); *H01Q 9/0407* (2013.01); *G04R 60/12* (2013.01); *G04R 20/04* (2013.01); *G04C 9/02* (2013.01); *G04C 10/02* (2013.01)

USPC ..... 368/47

(56) References Cited

U.S. PATENT DOCUMENTS

| | | | | |
|---|---|---|---|---|
| 6,542,120 | B1 | 4/2003 | Gilbertson | |
| 6,573,445 | B1 | 6/2003 | Burgers | |
| 7,190,638 | B2 | 3/2007 | Oguchi | |
| 7,391,677 | B2 | 6/2008 | Urano et al. | |
| 7,974,155 | B2 * | 7/2011 | Matsuzaki | 368/47 |
| 7,983,116 | B2 * | 7/2011 | Fujisawa | 368/47 |
| 8,467,272 | B2 | 6/2013 | Fujisawa | |
| 8,570,840 | B2 | 10/2013 | Fujisawa | |
| 2004/0004909 | A1 | 1/2004 | Fujimori | |
| 2004/0137963 | A1 | 7/2004 | Barras et al. | |
| 2004/0155818 | A1 | 8/2004 | Barras et al. | |
| 2004/0233789 | A1 | 11/2004 | Oguchi et al. | |
| 2005/0195689 | A1 | 9/2005 | Oguchi | |
| 2006/0153009 | A1 | 7/2006 | Matoge et al. | |
| 2006/0227058 | A1 | 10/2006 | Zellweger et al. | |
| 2008/0094942 | A1 | 4/2008 | Oguchi et al. | |
| 2009/0189809 | A1 * | 7/2009 | Baba | 342/357.12 |
| 2009/0229667 | A1 | 9/2009 | Shrotriya et al. | |
| 2010/0300507 | A1 | 12/2010 | Heng et al. | |
| 2011/0013491 | A1 | 1/2011 | Fujisawa | |
| 2011/0051561 | A1 | 3/2011 | Fujisawa | |
| 2014/0022871 | A1 * | 1/2014 | Fujisawa, Teruhiko | 368/28 |

FOREIGN PATENT DOCUMENTS

| | | | |
|---|---|---|---|
| EP | 1666994 | A2 | 6/2006 |
| EP | 1884753 | A1 | 2/2008 |
| EP | 2093634 | A2 | 8/2009 |
| EP | 2177962 | A2 | 4/2010 |
| JP | 7-87293 | | 9/1995 |
| JP | 08-254582 | | 10/1996 |
| JP | 10-197662 | | 7/1998 |
| JP | 11-112227 | | 4/1999 |
| JP | 2000-138607 | | 5/2000 |
| JP | 2001-015781 | | 1/2001 |
| JP | 2001-027680 | | 1/2001 |
| JP | 2004-003993 | | 1/2004 |
| JP | 2004-354365 | | 12/2004 |
| JP | 2006-189379 | | 7/2006 |
| JP | 2006-258704 | | 9/2006 |
| JP | 2007-093238 | | 4/2007 |
| JP | 2007-526985 | | 9/2007 |
| JP | 4044898 | | 11/2007 |
| WO | 03/005486 | A1 | 1/2003 |
| WO | 2004/114029 | A1 | 12/2004 |

OTHER PUBLICATIONS

Office Action, U.S. Appl. No. 12/580,553 dated Oct. 18, 2011.

European Search Report for Application No. 10174478.7, dated Nov. 15, 2011.

* cited by examiner

TIMEPIECE WITH INTERNAL ANTENNA

CROSS-REFERENCE TO RELATED APPLICATIONS

This application is a continuation of, and claims priority under 35 U.S.C. §120 on, application Ser. No. 14/033,780, filed Sep. 23, 2013, which is a continuation of application Ser. No. 13/875,520, filed May 2, 2013, now U.S. Pat. No. 8,570,840, which is a continuation of application Ser. No. 12/871,483, filed Aug. 30, 2010, now U.S. Pat. No. 8,467,272, which claims priority under 35 U.S.C. §119 on Japanese patent application nos. 2009-201557 and 2010-143886, filed Sep. 1, 2009 and Jun. 24, 2010, respectively. The content of each such related application is incorporated by reference herein in its entirety.

BACKGROUND

1. Field of Invention

The present invention relates to a timepiece with an internal antenna, and more particularly to a timepiece with a built-in patch antenna (microstrip antenna) that receives radio frequency signals transmitted from an external source.

2. Description of Related Art

Timepieces that have an antenna for receiving radio frequency signals are known from the literature. Included in these RF signals are satellite signals transmitted from positioning information satellites, for example.

A wristwatch that has a patch antenna for receiving satellite signals as taught in JP-T-2007-526985 (Japanese translation of PCT international application JP-A-2007-526985) is an example of a timepiece with an internal antenna.

More specifically, JP-T-2007-526985 describes a wristwatch case rendered by a cylindrical metal external case member with a bottom. A bezel made of a material (such as plastic) through which RF signals pass easily is connected to the top side (open side) of the external case member, and a crystal is disposed inside the bezel.

With this wristwatch, the drive staff of the hands that display the time is disposed in the center of the surface of the dial. When the case is metal, the patch antenna inside the case is preferably disposed as close as possible to the face side of the timepiece, that is, the dial, so that RF signals can be received through the face side of the timepiece.

As a result, the patch antenna must be disposed between the drive staff and the inside circumference surface of the case. The patch antenna described in JP-T-2007-526985 is therefore disposed to a position offset from the plane center of the case toward the 12:00 o'clock position of the dial.

Because the patch antenna is a flat antenna, the thickness can be reduced and increase in the timepiece thickness can be suppressed when the patch antenna is incorporated inside the wristwatch.

However, in order to ensure the necessary reception performance, the patch antenna must have a plane area of a certain size. Recent technological advances in dielectric materials and radio sensitivity have enabled reducing the size of the patch antenna to some degree, but further reduction in size is complicated by the need to ensure the required reception performance. The plane area of a wristwatch must also be kept to a size that enables wearing on the wrist.

Therefore, when the patch antenna is located between the inside circumference surface of the case and the drive staff located in the plane center of the timepiece, the patch antenna is disposed adjacent to the case as shown in FIG. 1 and FIG. 2 in JP-T-2007-526985.

However, signal reception by the patch antenna will be easily affected if a case made from metal or other conductive material is adjacent to the side of the antenna (the outside circumference side facing the inside circumference surface of the case), and reception performance will drop. Reception performance is therefore assured in JP-T-2007-526985 by extending the bottom edge of the bezel to near the bottom surface of the patch antenna so that the side of the patch antenna is covered by the bezel.

In addition to practical functionality such as displaying the time and communication, however, timepieces, and particularly wristwatches, also need an appearance of quality. Such timepieces therefore generally use a metal material on the outside of the case.

However, a problem with the timepiece taught in JP-T-2007-526985 is that the plastic bezel occupies a large area and the quality of the timepiece therefore appears lower.

On the other hand, if a metal case is used to improve the appearance of quality, reception performance drops because the patch antenna is adjacent to a metal case as described above. More specifically, because the patch antenna is unidirectional, it is preferable to an non-directional antenna when RF signals are received through the open side of the metal case, that is, from the crystal and dial side of the timepiece.

Even so, because the patch antenna works on the same principle as a slot antenna and the strongest signals are emitted from the gap between the end of the top conductor (antenna end) and the ground plane, performance drops sharply if metal is close to the side of the patch antenna. A significant drop in the reception performance of the antenna is therefore a problem.

SUMMARY OF INVENTION

A timepiece with an internal antenna according to the present invention can ensure good reception performance even when the outside case is metal.

A first aspect of the invention is a timepiece that includes: a case; a dial that is made from a nonconductive material; a solar panel that has an opening and is disposed at a side opposite of a display side of the dial, the solar panel receiving light incident from the display side of the dial; a patch antenna that is disposed (i) at a side opposite of a light receiving side of the solar panel, and (ii) at a position overlapping the opening in plan view; and a date wheel made from nonconductive material that is disposed between the solar panel and the patch antenna in lateral view, and is disposed between the solar panel and the patch antenna in lateral view, and is disposed at a position overlapping, at least in part, the patch antenna in plan view. The dial has a date window for exposing at least part of the date wheel, and the date window is formed at a position overlapping the opening in plan view.

The patch antenna may include a dielectric and an electrode formed on the dielectric. The patch antenna may be an inverted-F antenna, which may be rendered be a chip antenna rendering on a ceramic dielectric package.

A size of the opening may be set to be the same as a plane area of the patch antenna.

The timepiece may further include a receiver unit that processes signals received by the patch antenna. The receiver unit may also output positioning information. The receiver unit may be configured to process signals when an operating button is manually operated by a user. The receiver unit may be configured to process signals when the internal time kept by a control unit reaches a preset scheduled reception time. The receiver unit may be disposed where it does not overlap a storage cell that is charged by the solar panel.

In embodiments having a control unit that keeps internal time, a storage unit may be provided to store time difference data. In such case, the control unit may be further configured to calculate a local time based on positioning information, the internal time, and the time difference data.

The solar panel may include four solar cells.

The timepiece may be a wristwatch.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Embodiment 1

A first embodiment of the invention is described below with reference to the accompanying figures.

Figure 1:
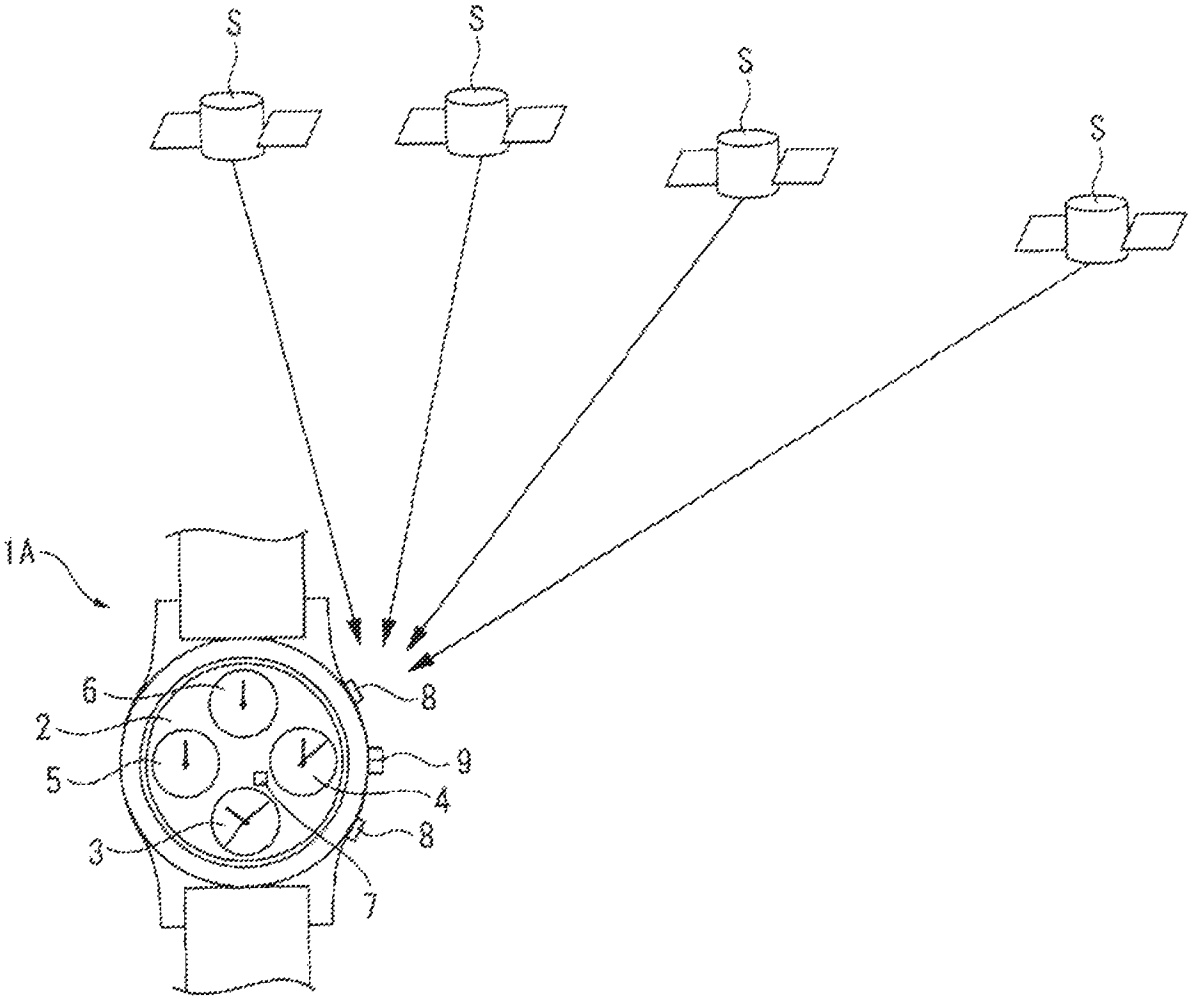
FIG. 1 shows a GPS wristwatch according to the first embodiment of the invention.

FIG. 1 shows a GPS wristwatch 1A according to a preferred embodiment of a timepiece with an internal antenna according to the invention.

As shown in FIG. 1, the GPS wristwatch 1A is configured to adjust the internally kept time by receiving satellite signals and acquiring satellite time information from a plurality of GPS satellites S orbiting the Earth in space on specific orbits.

Note that the GPS satellites S are an example of a positioning information satellite in the invention, and a plurality of satellites orbit the Earth in space. Today there are approximately 30 GPS satellites S in orbit.

Operating buttons 8 for external operations and a crown 9 are also disposed to the GPS wristwatch 1A.

Configuration of a GPS Wristwatch

Figure 2:
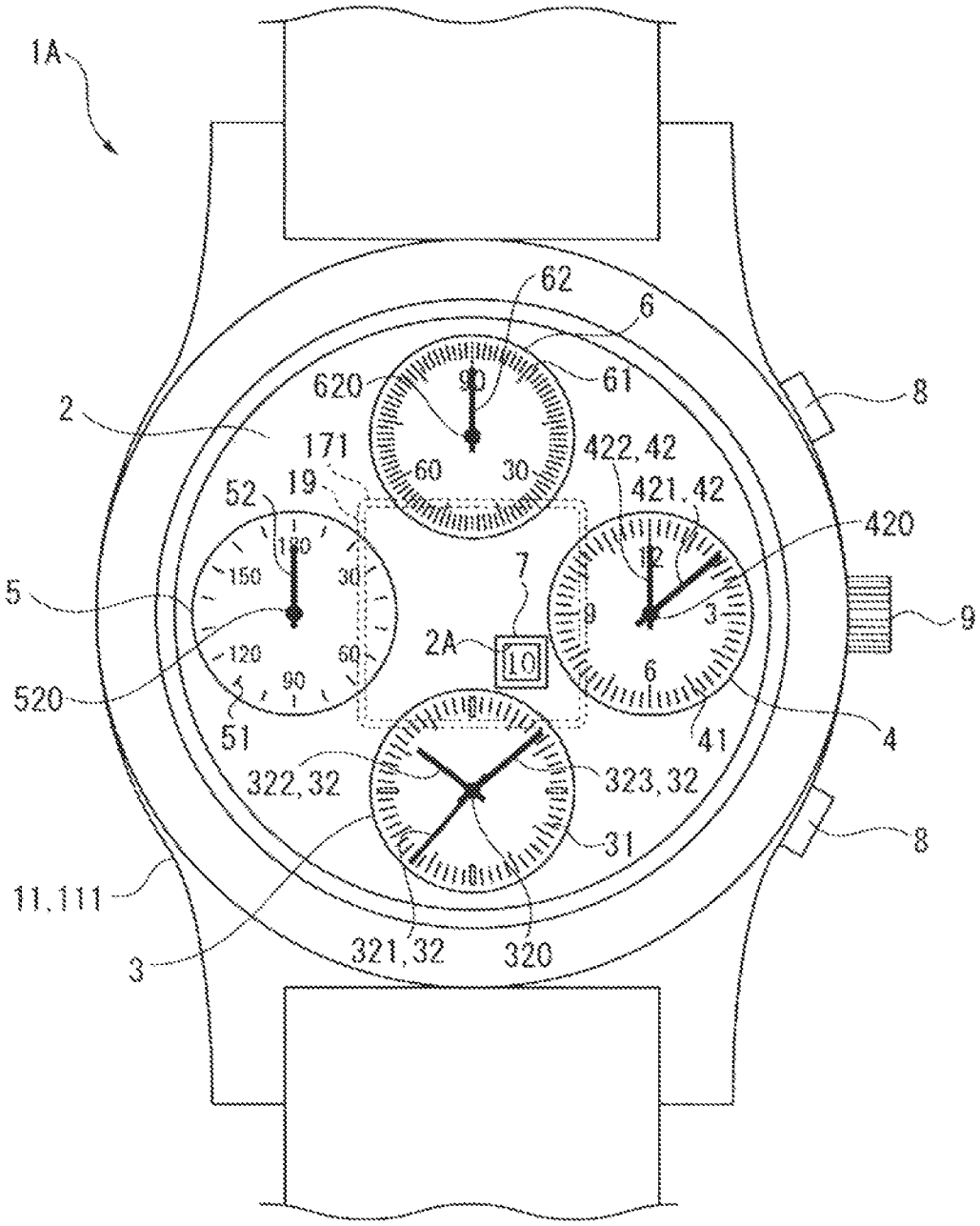
FIG. 2 is a plan view of the GPS wristwatch.
Figure 3:
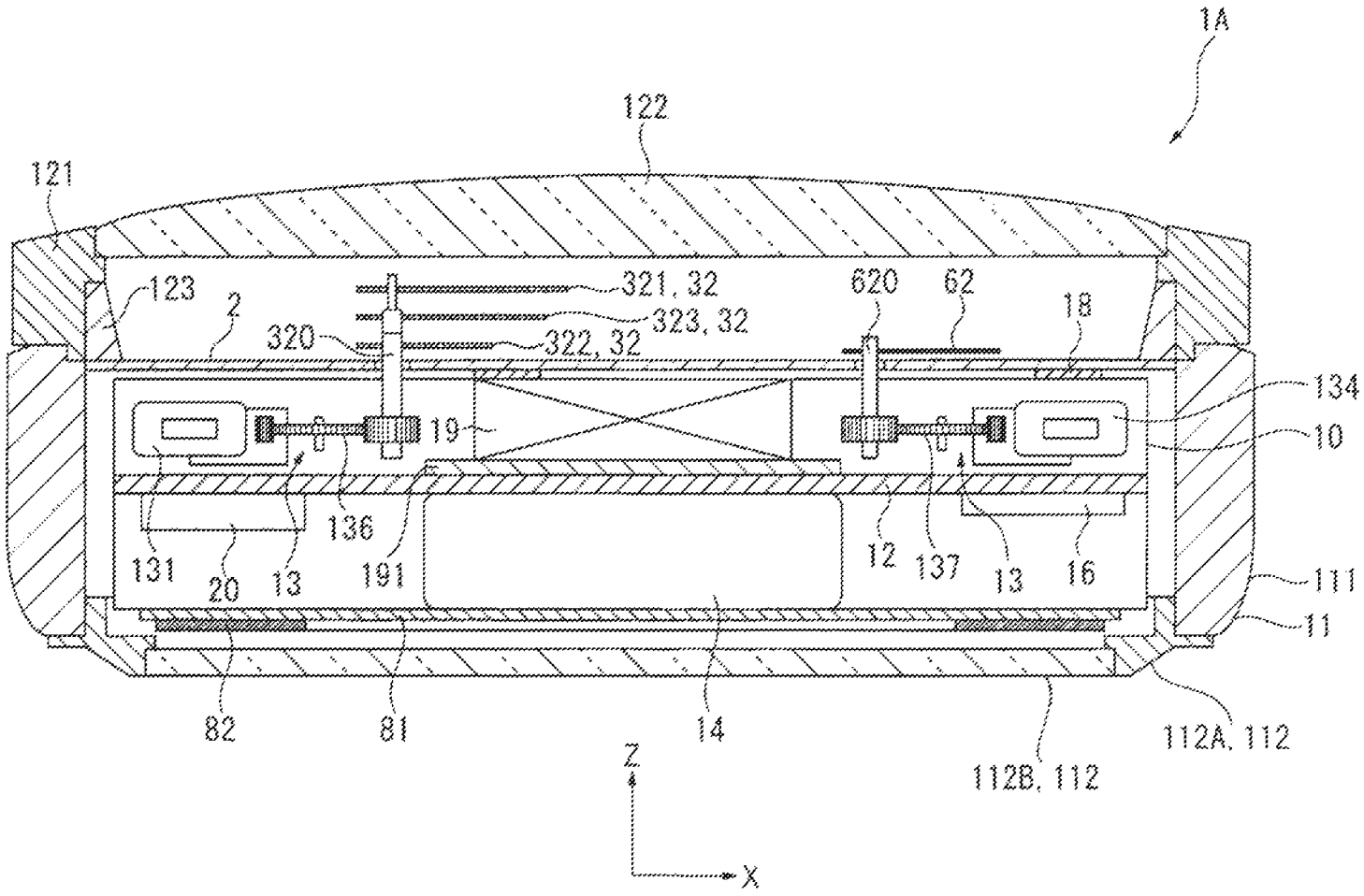
FIG. 3 is a section view of the GPS wristwatch.
Figure 4:
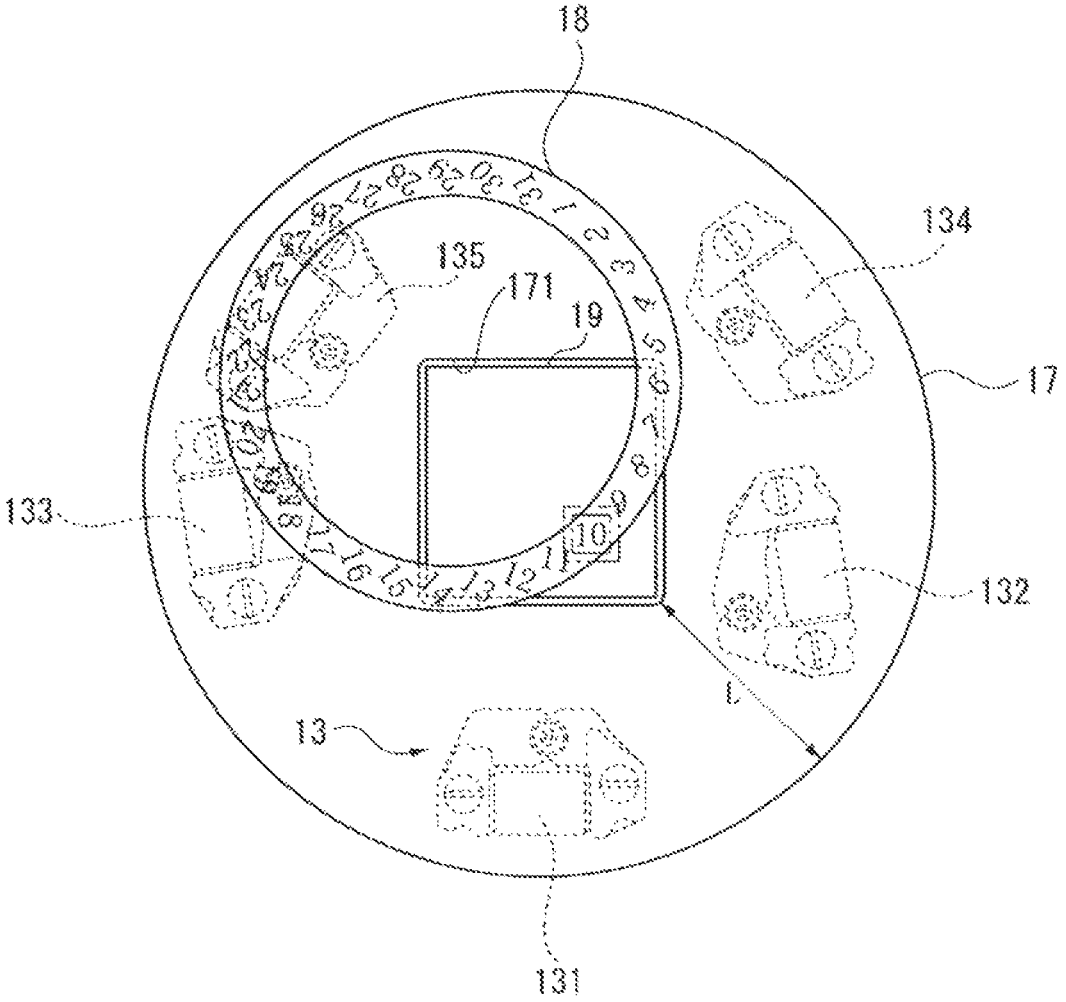
FIG. 4 is a plan view of the movement assembled into the GPS wristwatch.

FIG. 2 is a plan view of the GPS wristwatch 1A. FIG. 3 is a section view of the GPS wristwatch 1A. FIG. 4 is a plan view of the movement 10.

The GPS wristwatch 1A has a dial 2 made from a non-conductive plastic material such as polycarbonate.

The GPS wristwatch 1A also has a first time display unit 3, a second time display unit 4, a longitude display unit 5, a latitude display unit 6, and a date display unit 7 each rendered by a chapter ring and one or more hands and disposed to the dial 2.

The first time display unit 3 has a round chapter ring 31 disposed at 6:00 o'clock on the dial 2, and first hands 32. The chapter ring 31 has 60 markers disposed around the outside edge.

The first hands 32 are made of metal, are supported on a three-part staff 320 passing through the center of the first time display unit 3, and include a first second hand 321, a first minute hand 323, and a first hour hand 322.

The staff 320 to which the first second hand 321, first hour hand 322, and first minute hand 323 are attached is driven by a stepper motor 131 described below.

Similarly to the first time display unit 3, the second time display unit 4 includes a round chapter ring 41 disposed at 3:00 o'clock on the dial 2, and second hands 42. The chapter ring 41 is divided into 60 markers around the outside edge.

The second hands 42 are metal, supported on a two-part staff 420 passing through the center of the second time display unit 4, and include a second minute hand 421 and second hour hand 422.

The staff 420 to which the second minute hand 421 and second hour hand 422 are attached is also driven by a stepper motor 132 described below.

This configuration enables displaying the current time in two different time zones, that is, a so-called dual time display, by means of the first time display unit 3 and second time display unit 4. For example, the local time when on a trip could be displayed on the first time display unit 3 while the local time in the user's home country could be displayed using the second time display unit 4.

The longitude display unit 5 includes a round chapter ring 51 disposed at 9:00 o'clock on the dial 2, and a longitude hand 52. The chapter ring 51 is divided into 18 markers around the outside edge.

The hand 52 is metal, supported on a staff 520 passing through the center of the longitude display unit 5, and is driven by a stepper motor 133 described below.

Note that when positioning information is not displayed in the longitude display unit 5, the remaining battery capacity may be displayed by the hand 52.

The latitude display unit 6 includes a round chapter ring 61 disposed at 12:00 o'clock on the dial 2, and a latitude hand 62. The chapter ring 61 is divided into 90 markers around the outside edge.

The hand 62 is metal, supported on a staff 620 passing through the center of the latitude display unit 6, and is driven by a stepper motor 134 described below.

Note that when positioning information is not displayed in the latitude display unit 6, the day of the week may be displayed by the hand 62. In this configuration the chapter ring 61 may display markers for the days of the week.

The date display unit 7 has a rectangular date window 2A disposed near the center of the dial 2, and a date wheel 18 disposed behind the dial 2. The date window 2A is offset from the center of the dial 2 towards the 4-5:00 o'clock position near the first time display unit 3 and second time display unit 4. The date wheel 18 is driven by a stepper motor 135 described below, and a date (day number) printed on the date wheel 18 is exposed and displayed from the date window 2A.

Internal Configuration of the GPS Wristwatch

As shown in FIG. 2 and FIG. 3, the GPS wristwatch 1A includes a movement 10 that drives hands 32, 42, 52, and 62, and an external case 11 that houses the movement 10.

The case 11 includes a cylindrically shaped case member 111, and a back cover 112 that closes one open end of the case 11 (the bottom end in FIG. 3).

The back cover 112 includes an annular metal first back cover part 112A, and a round glass second back cover part 112B that is held by the first back cover part 112A. The first back cover part 112A is held by a threaded connection to the end of the case member 111.

The case member 111 and first back cover part 112A are made from a conductive metal such as SUS (stainless steel) or titanium alloy.

The movement 10 includes a circuit board 12, drive mechanism 13, storage cell 14, base plate 17, and patch antenna 19.

The circuit board 12 is populated with circuit devices including a control unit (control module) 16 that controls the drive mechanism 13, and a receiver unit (GPS reception module) 20 that processes signals received from GPS satellites S. More specifically, as shown in FIG. 3, the receiver unit 20 is mounted to the bottom side of the circuit board 12 (the opposite side as the patch antenna 19). Because metal circuit patterns are formed on the circuit board 12, noise emitted from a crystal oscillator circuit 23 disposed to the receiver unit 20 as described below (see FIG. 6) can be blocked by the circuit board 12. Therefore, compared with disposing the receiver unit 20 on the top side of the circuit board 12, the effect of noise on the patch antenna 19 can be reduced and reception performance can be improved. Space can also be used efficiently because the receiver unit 20 is placed in the dead space (the space around the storage cell 14) on the bottom side of the circuit board 12. In addition, because the receiver unit 20 is located where it does not overlap the storage cell 14 in the plane direction, the thickness of the GPS wristwatch 1A can be reduced.

The drive mechanism 13 includes the foregoing stepper motors 131 to 135, wheel trains 136 and 137 that transfer drive power from the stepper motors 131 to 135 to the staffs 320, 420, 520, 620 and the 18, and a drive circuit 130 (see FIG. 6) that drives the stepper motors 131 to 135 according to control signals from the control unit 16. The motor drive control means of the invention is thus rendered by the drive circuit 130.

The hands 32, 42, 52, 62 and date wheel 18 are driven by the drive mechanism 13 to display such information as the time, longitude, and latitude.

The storage cell 14 is a rechargeable battery such as a lithium ion battery, and supplies power to the drive mechanism 13, control unit 16, and receiver unit 20.

The base plate 17 is made of a nonconductive plastic material, and is disposed on the back side of the dial 2. An opening 171 is formed in the middle of the base plate 17 as shown in FIG. 4.

The date wheel 18 is disposed to the base plate 17. The date wheel 18 is made of a nonconductive plastic material and formed in the shape of a ring. The numbers 1 to 31 are printed on the date wheel 18 to display the day number. Because markers for 31 days must be printed, each number will be small and difficult to read if the diameter of the date wheel 18 is too small.

As a result, the diameter of the date wheel 18 is greater than half the diameter of the dial 2 and base plate 17 as shown in FIG. 4. The date wheel 18 is disposed according to the position of the date window 2A in the dial 2 so that part of the date wheel 18 will be positioned in the opening 171, a number printed on the date wheel 18 will be exposed from the date window 2A of the dial 2, and the date can be read from the outside.

The patch antenna 19 receives circularly polarized signals transmitted from positioning information satellites in this embodiment of the invention. The patch antenna works by emitting a strong field along the edges of the patch (antenna conductor) into space from the edges of the patch (towards the transmitting antenna), and the top surface of the antenna as well as the sides of the antenna must therefore be separated several millimeters from metal. A patch antenna according to the invention refers to a flat antenna having the ground plane and antenna conductor substantially parallel, and one side resonating at half wavelength, but also includes inverted-F antennae resonating at a quarter wavelength by shorting one side of the antenna conductor to the ground plane. An inverted-F antenna enables reducing the antenna size by halving the radiation conductor of a half wave patch antenna, but the operating principle relating to signal radiation from the antenna side is the same as a half wave patch antenna. So-called chip antennae rendering an inverted-F antenna on a ceramic dielectric package are also included in the patch antenna of the invention. More specifically, a patch antenna of the invention refers to the operating principle of the antenna.

Figure 5A:
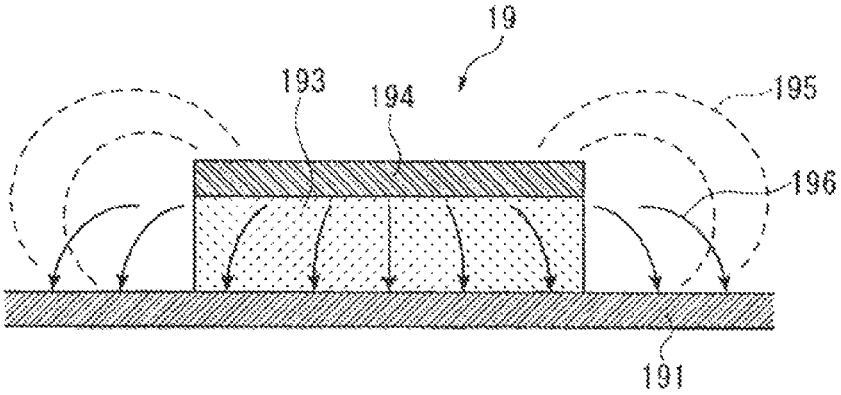
FIG. 5A is a section view showing the structure of the patch antenna.

More specifically, as shown in FIG. 5A, a patch antenna 19 according to this embodiment of the invention is a patch antenna having a ceramic dielectric body 193 disposed on an antenna substrate 191 that is the ground plane, and a silver (Ag) conductive antenna feed 194 printed on the dielectric body 193. Note that in FIG. 5A dotted lines 195 denote the signals received by the patch antenna 19, and arrows 196 denote lines of electric force.

To facilitate adjusting the frequency of the patch antenna 19, the antenna substrate 191 is separate from the circuit board 12 on which the receiver unit 20, that is, the GPS reception module, is mounted. The signal lines of the antenna substrate 191 of the patch antenna 19 are soldered to the circuit board 12 after frequency adjustment.

Figure 5B:
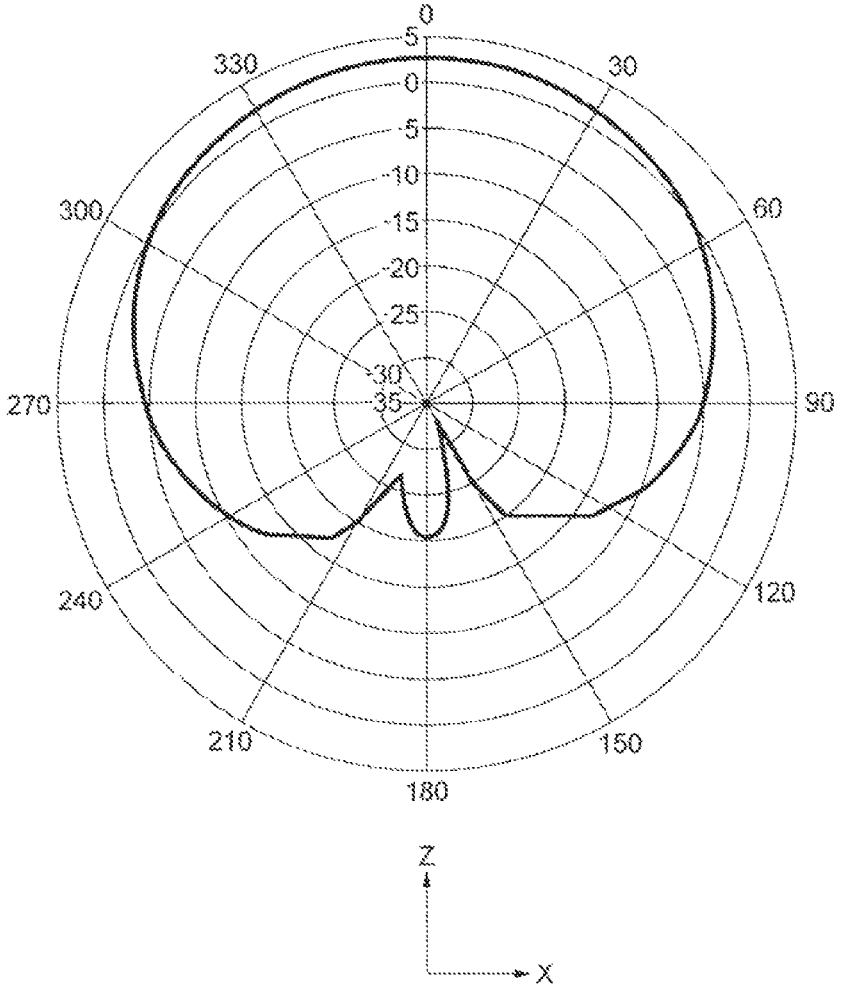
FIG. 5B shows the radiation pattern of the patch antenna.

FIG. 5B shows the radiation pattern of the patch antenna 19. As shown in FIG. 3, the plane of the patch antenna 19 is on axis X and the zenith is indicated by axis Z.

As shown in FIG. 5B, the patch antenna 19 has the greatest directivity at the zenith in the direction of axis Z, and can most easily receive radio signals that are perpendicularly incident to the dial 2. In addition, because directivity in the X axis direction, that is, to the sides of the patch antenna 19, is less than on axis Z but is still strong, reception performance will be affected if the metal case 11 is proximal to the side of the patch antenna 19.

However, because directivity in the −Z direction, that is, to the bottom of the patch antenna 19, is weak, reception performance is less affected when a metal storage cell 14 is located therebelow when compared with a non-directional antenna with uniform directivity all around.

The patch antenna 19 is rectangular in plan view and is inserted to the rectangular opening 171 in the base plate 17. As a result, part of the date wheel 18 is located on the top (dial 2) side of the patch antenna 19.

The patch antenna 19 is disposed to a position separated at least a specified distance from the inside circumference surface of the case member 111. More specifically, as shown in FIG. 4, at least a specified minimum gap L is rendered between the outside surface of the patch antenna 19 and the inside circumference surface of the case member 111. Compared with a configuration in which the patch antenna 19 is located offset from the plane center, distance L can be set to the greatest distance possible in this embodiment of the invention because the patch antenna 19 is disposed in the plane center of the GPS wristwatch 1A.

Note that the specific size of this "specified distance" may be set to assure the reception performance required by the GPS wristwatch 1A with consideration for deterioration in reception performance with proximity of the patch antenna 19 to the metal case member 111, and the angle of incidence range of the radio signals that can be received by the patch antenna 19 without being blocked by the case member 111.

Note that in this embodiment of the invention the dial 2 is disposed at substantially the same elevation (height) as the top of the case member 111, and the patch antenna 19 is disposed on the back side of the dial 2 with the date wheel 18 therebetween. As a result, the top surface of the patch antenna 19 is substantially even with the top surface of the case member 111.

The stepper motors 131 to 135 and wheel trains 136 and 137 of the drive mechanism 13 are disposed between the patch antenna 19 and the inside surface of the case member 111. As a result, this specified distance L is large enough to accommodate the stepper motors 131 to 135. In addition, as shown in FIG. 2 and FIG. 3, the hand staffs 320, 420, 520, and 620 that are driven by the drive mechanism 13 are also disposed between the patch antenna 19 and the inside surface of the case member 111.

The stepper motors 131 to 135, wheel trains 136 and 137, and hand staffs 320, 420, 520, and 620 are therefore disposed around the patch antenna 19 in the movement 10 according to this embodiment of the invention. In other words, the patch antenna 19 is disposed between the staffs 320 and 620 and between the staffs 420 and 520.

Note that the hand staffs 320, 420, 520, and 620 are normally metal, but because they are thin pipe-like members they have substantially no affect on reception performance compared with the case 11 even if disposed proximally to the patch antenna 19. Note, further, that the effect on reception performance can be even further reduced by making the hand staffs 320, 420, 520, and 620 from plastic or other nonconductive material.

Furthermore, the movement 10 in this embodiment of the invention thus has the drive mechanism 13 and patch antenna 19, the circuit board 12, and then the storage cell 14 disposed sequentially on different layers from the dial 2 side to the back cover 112 side of the movement 10. The receiver unit 20 and control unit 16 mounted on the circuit board 12 are disposed on the back cover side (the side facing the back cover 112) of the circuit board 12.

A magnetic shield 81 is disposed below the storage cell 14 (on the back cover 112 side), and a charge coil 82 is disposed on the back cover side of the magnetic shield 81. The storage cell 14 can therefore be charged with power by means of the charge coil 82 by contactless electromagnetic induction from an external charger not shown. As a result, the glass second back cover part 112B of the back cover 112 is disposed to the part of the back cover 112 overlapping the charge coil 82 in plan view in order to transmit power.

The magnetic shield 81 disposed above the charge coil 82 (on the storage cell 14 side) is provided to reduce eddy current loss of the metal can of the storage cell 14 due to the magnetic field induced in the charge coil 82.

The GPS wristwatch 1A also has a bezel 121 disposed on the top side of the case member 111.

The bezel 121 is ring-shaped and is connected to the case member 111 by a pressure-fit construction. The crystal 122 is disposed to the inside circumference side of the bezel 121.

A dial ring 123 is disposed on the inside circumference side of the bezel 121.

The dial ring 123 is ring-shaped with an outside diameter matching the dial 2 and the inside circumference part sloped towards the dial 2.

Most radio signals received by the patch antenna 19 are incident to the patch antenna 19 through the crystal 122. As a result, reception by the patch antenna 19 will not be disabled even if the bezel 121 and dial ring 123 are metal. However, because the bezel 121 and dial ring 123 are disposed above the patch antenna 19 and affect reception by the patch antenna 19, they are made from a nonconductive material in this embodiment of the invention. The bezel 121 can be plastic, but because it is exposed to the outside and subject to scratching, the bezel 121 is made from a hard, scratch-resistant ceramic.

Circuit Configuration of the GPS Wristwatch

Figure 6:
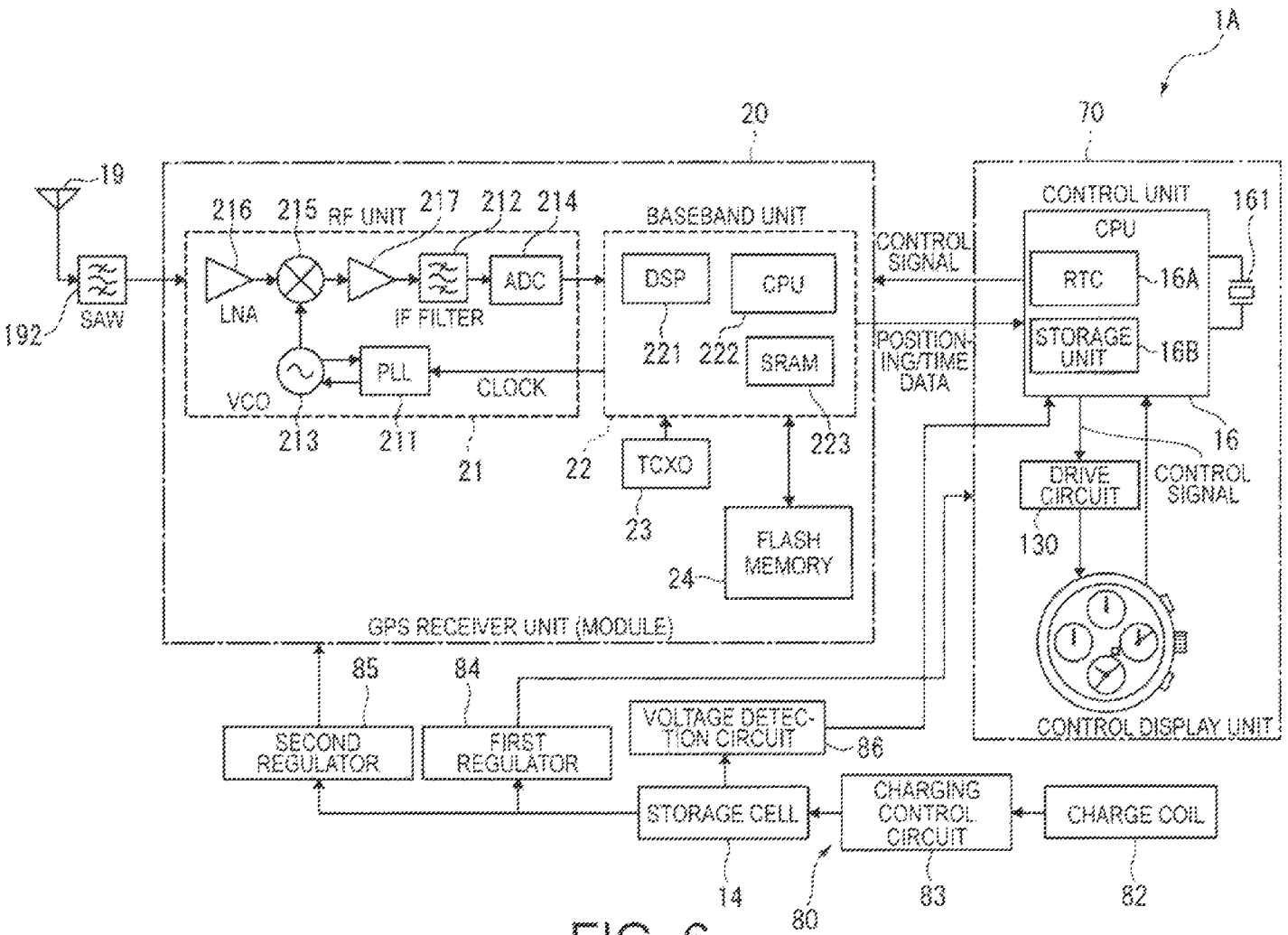
FIG. 6 is a block diagram of the circuit configuration of the GPS wristwatch.

FIG. 6 schematically describes the circuit configuration of the GPS wristwatch 1A.

As shown in FIG. 6, the GPS wristwatch 1A includes a patch antenna 19, filter (SAW) 192, receiver unit 20, control display unit 70, and power supply unit 80.

The filter (SAW) 192 is a bandpass filter that extracts 1.5 GHz satellite signals. A low noise amplifier (LNA) may be inserted between the patch antenna 19 and filter 192 to improve reception sensitivity.

Note, further, that the filter (SAW) 192 may be incorporated in the receiver unit 20.

The receiver unit 20 processes the satellite signals extracted by the filter 192, and includes an RF unit (radio frequency) 21 and baseband unit 22.

The RF unit 21 includes a PLL circuit 211, IF filter 212, a VCO (voltage controlled oscillator) 213, an A/D converter 214, a mixer 215, an LNA (low noise amplifier) 216, and an IF amplifier 217.

The satellite signal extracted by the filter 192 is amplified by the LNA 216, mixed by the mixer 215 with a signal from the VCO 213, and down-converted to a signal in the intermediate frequency band.

The IF signal output by the mixer 215 passes the IF amplifier 217 and IF filter 212, and is converted to a digital signal by the A/D converter 214.

The baseband unit 22 includes a DSP (digital signal processor) 221, CPU (central processing unit) 222, and SRAM (static random access memory) 223. A TCXO (temperature-compensated crystal oscillator) 23 and flash memory 24 are also connected to the baseband unit 22.

The digital signal from the A/D converter 214 of the RF unit 21 is input to the baseband unit 22, which processes the satellite signals based on a control signal and acquires satellite time information and positioning information therefrom.

Note that the clock signal for the PLL circuit 211 is output from the TCXO 23.

The control display unit 70 includes the control unit 16 (CPU) and a display unit including the drive circuit 130 that drives the hands 32, 42, 52, 62 and the first time display unit 3, second time display unit 4, longitude display unit 5, and latitude display unit 6.

The control unit 16 includes an RTC (real-time clock) 16A and storage unit 16B as hardware components.

The RTC 16A keeps internal time using a reference signal output from a crystal oscillator 161. The timekeeping means of the invention is thus rendered by the RTC 16A.

The storage unit 16B stores the time data and positioning data output from the receiver unit 20. Time difference data for the positioning information is also stored in the storage unit 16B, and the local time at the current location can be calculated from the internal time kept by the RTC 16A and the time difference data.

By having the receiver unit 20 and control display unit 70 described above, the GPS wristwatch 1A in this embodiment can automatically adjust the displayed time based on the signal received from the GPS satellite.

The control unit 16 is configured to execute an automatic reception process that operates the receiver unit 20 and executes a reception process when the internal time kept by the RTC 16A reaches a preset scheduled reception time (such as 3:00 a.m.), and to execute a manual reception process that executes the reception process when triggered by manually operating an operating button 8, for example. The scheduled reception means of the invention is thus rendered by the control unit 16.

The power supply unit 80 includes the charge coil 82, a charging control circuit 83, the storage cell 14, a first regulator 84, a second regulator 85, and a voltage detection circuit 86.

The charge coil 82 supplies power to the storage cell 14 through the charging control circuit 83 and thus charges the storage cell 14.

The storage cell 14 supplies drive power through the first regulator 84 to the control display unit 70, and supplies drive power through the second regulator 85 to the receiver unit 20.

The voltage detection circuit 86 monitors the voltage of the storage cell 14 and outputs to the control unit 16. The control unit 16 can therefore know the storage cell 14 voltage and control the reception process.

The effects of the GPS wristwatch 1A according to this embodiment of the invention are described next.

Because the patch antenna 19 is separated at least a specified distance from the inside surface of the cylindrical case member 111 in this embodiment of the invention, the effect of a conductive case member 111 can be reduced and a drop in reception performance can be prevented even when the cylindrical case member 111 uses a conductive material. More specifically, because the patch antenna 19 is located in the plane center of the GPS wristwatch 1A in this embodiment of the invention, specified distance L can be maximized and reception performance can be maximized compared with placing the patch antenna 19 in a different location.

In addition, when the patch antenna 19 is separated at least a specified distance from the inside surface of the case 11, the hand staffs 320, 420, 520, and 620 and wheel trains 136 and 137 can be disposed in the space between the patch antenna 19 and case 11, this space can be used efficiently, and a small timepiece can be achieved.

Furthermore, because the patch antenna 19 is located in the plane center of the GPS wristwatch 1A, the patch antenna 19 can receive radio signals that are incident from above and radio signals that are incident diagonally from the sides without obstruction by the case member 111 even when the top of the case member 111 is substantially at the same elevation as the top of the patch antenna 19. The metal case member 111 can therefore occupy a larger area in the appearance of the timepiece 1A while assuring good reception process for the patch antenna 19 and improving the appearance of timepiece 1A quality.

Furthermore, because the specified distance L is sized to accommodate the stepper motors 131 to 135, the stepper motors 131 to 135 can be disposed anywhere around the patch antenna 19, the freedom of the layout of the stepper motors 131 to 135 and the hands 32, 42, 52, 62 driven by the stepper motors 131 to 135 can be improved, and the space around the patch antenna 19 can be used efficiently.

A timepiece can therefore be rendered with the layout of the hands 32, 42, 52, 62 different from that of a common analog timepiece having the hand staff disposed in the plane center of the dial 2, a plurality of hand staffs 320, 420, 520, and 620 can be disposed around the patch antenna 19 as described in this embodiment, and a timepiece with multiple dials and hands for displaying longitude, latitude, or other information in addition to the time can be achieved.

Furthermore, because the stepper motors 131 to 135 used as the drive source for driving the hands 32, 42, 52, 62 are disposed between the inside surface of the cylindrical case member 111 and the outside surface of the patch antenna 19, the patch antenna 19 and stepper motors 131 to 135 will not overlap in the thickness direction of the GPS wristwatch 1A. As a result, the thickness of the GPS wristwatch 1A according to this embodiment of the invention can be reduced compared with a timepiece in which the patch antenna 19 and stepper motors 131 to 135 overlap in the thickness direction. More particularly, because the patch antenna 19 and stepper motors 131 to 135 are relatively thick compared with other parts in the GPS wristwatch 1A, the thickness of the GPS wristwatch 1A can be greatly reduced by disposing these parts so that they do not overlap in plan view.

Furthermore, patch antennas 19 are flat unidirectional antennas with narrow directivity, but because the circuit board 12 to which the patch antenna 19 is disposed functions as a ground plane, radio signals incident from the outside are reflected by the circuit board 12 and can be guided to the patch antenna 19. In addition to radio signals that are directly incident to the patch antenna 19, the patch antenna 19 can therefore receive radio signals that are reflected from the circuit board 12 and indirectly incident. The patch antenna 19 can therefore be assured of better reception performance.

In addition, because the patch antenna 19 receives circularly polarized waves, a timepiece having a function for adjusting the time using time information contained in a satellite signal, for example, can reliably receive signals from positioning information satellites anywhere on Earth and can constantly keep accurate time.

Embodiment 2

Figure 7:
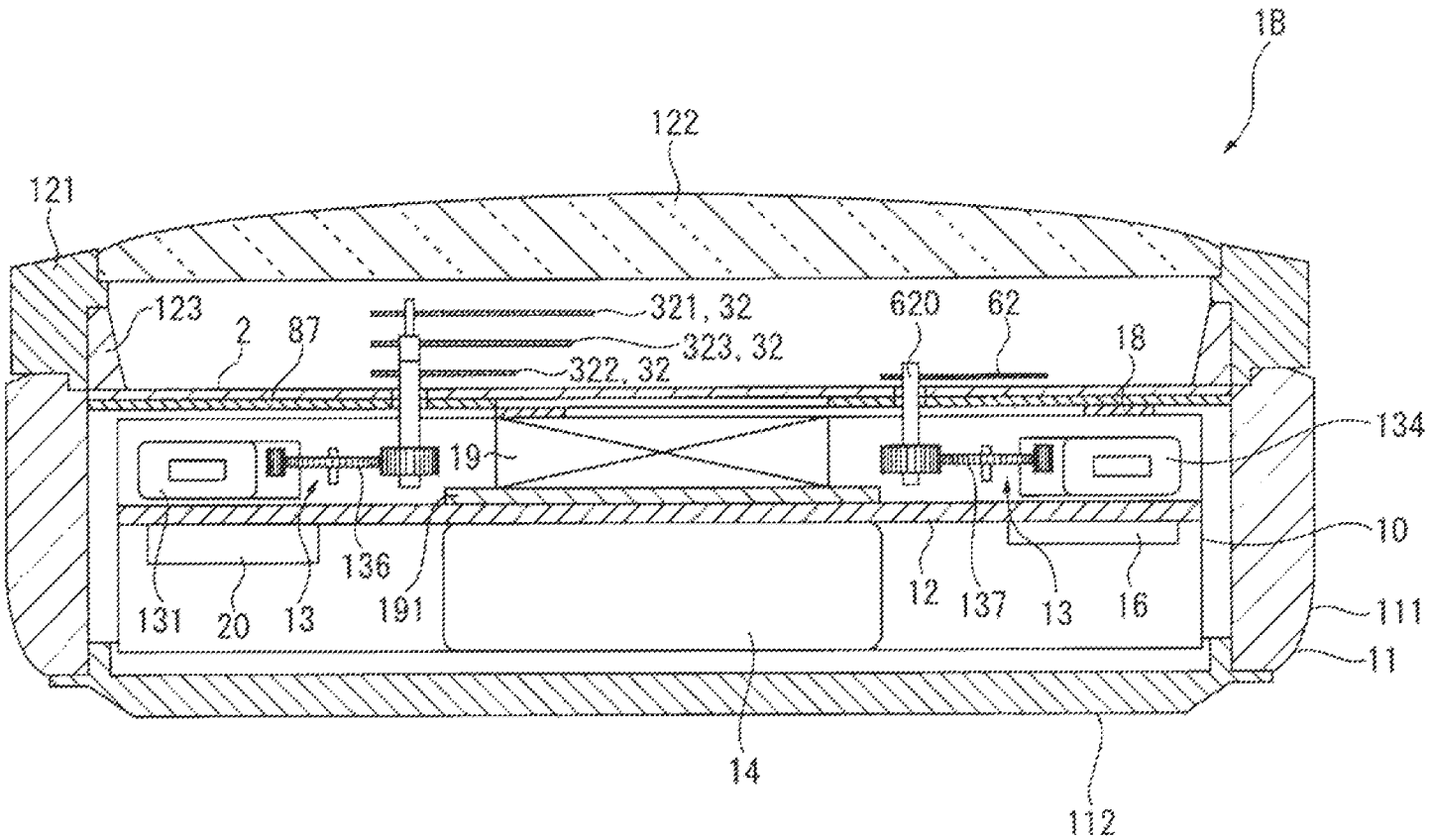
FIG. 7 is a section view of a GPS wristwatch according to a second embodiment of the invention.
Figure 8:
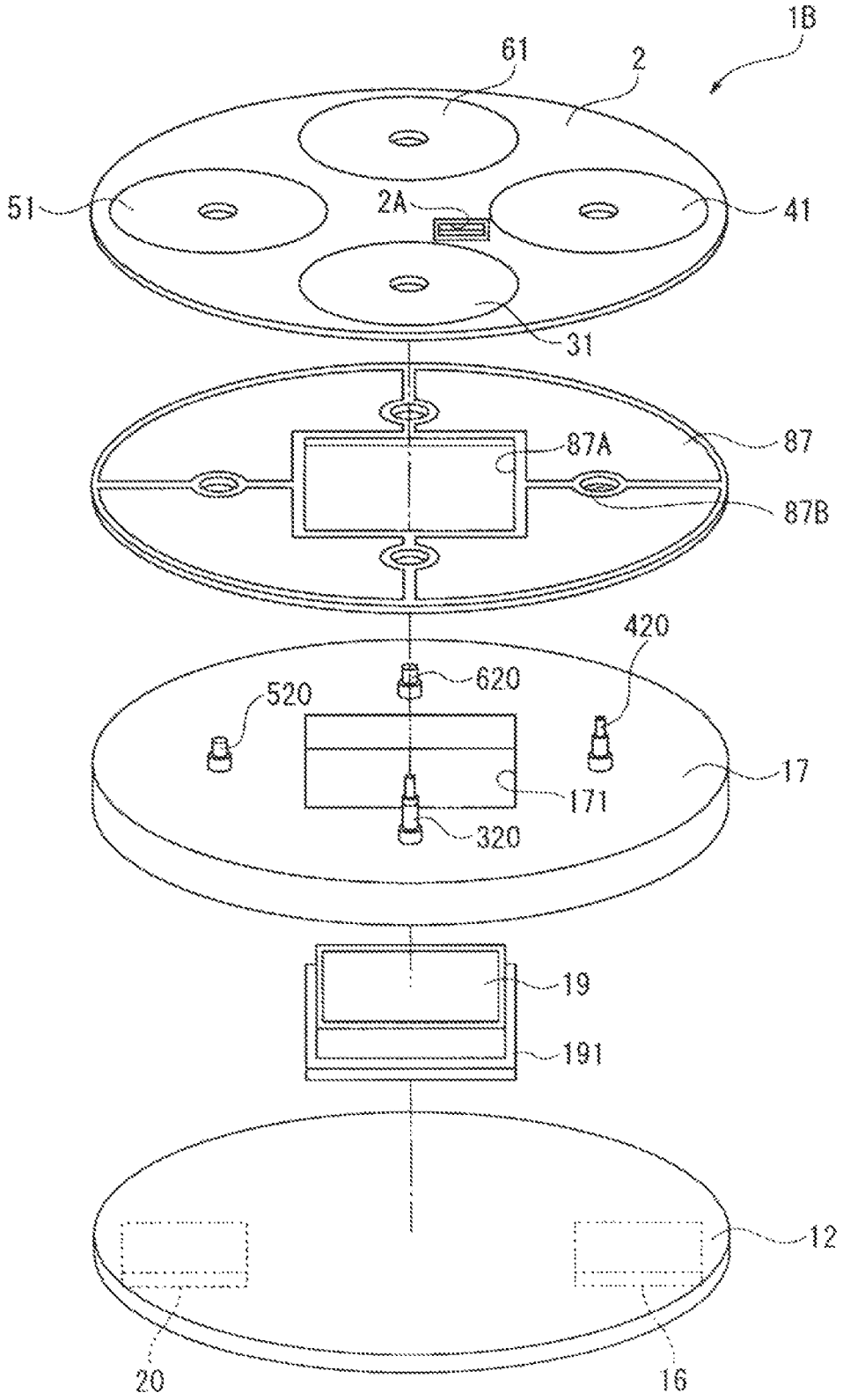
FIG. 8 is an exploded oblique view schematically showing the main parts related to the second embodiment.

FIG. 7 is a section view of a GPS wristwatch 1B according to a second embodiment of the invention. FIG. 8 is an exploded oblique view schematically showing the main parts of the GPS wristwatch 1B according to this embodiment of the invention. Note that like parts in this embodiment and the foregoing embodiment are identified by like reference numerals and further description thereof is omitted.

Power is supplied to the storage cell 14 by the charge coil 82 in the foregoing embodiment, and this embodiment differs by using a solar panel 87 to supply power to the storage cell 14.

In addition, because this embodiment does not use a charge coil 82, there is no need to use a glass second back cover part 112B for power transmission, and the entire back cover 112 is metal.

As shown in FIG. 7 and FIG. 8, the solar panel 87 is disposed between the dial 2 and the date wheel 18. This solar panel 87 is annular with a rectangular window 87A that exposes the patch antenna 19 in the middle. The window 87A is formed to the same shape and size and in the same plane position as the opening 171 in the base plate 17. As a result, the date window 2A is disposed to a position overlapping both the opening 171 and the window 87A in plan view.

The solar panel 87 is a common solar panel composed of four solar cells and has a metal substrate. The solar cells are connected in series and the area of the solar cells is maximized by rendering four through-holes 87B through which the hand staffs 320, 420, 520, and 620 pass on the lines separating the solar cells from each other. The solar panel 87 produces power from light incident from the crystal 122 side. Power produced by the solar panel 87 passes through the charging control circuit 83 and charges the storage cell 14 in the same way as in the first embodiment. The dial 2 in this embodiment is made from polycarbonate or other transparent plastic material so that it does not interfere with light passing to the solar panel 87.

When a window 87A is formed in the solar panel 87, the light-collecting surface area is reduced and power output drops accordingly. For power generating performance, the area of the window 87A is therefore preferably as small as possible.

In addition, because the solar panel 87 has a metal substrate, radio waves passing through portions other than the window 87A are greatly attenuated. Therefore, in order to improve the reception performance of the patch antenna 19, the surface area of the window 87A is preferably as large as possible.

The area of the window 87A may therefore be determined with consideration for the foregoing two conditions, and in this embodiment of the invention is set to the same size as the plane area of the patch antenna 19.

In addition to the effect of the first embodiment described above, the GPS wristwatch 1B according to this embodiment of the invention has the following effect.

By using an optically transparent dial 2 and disposing the solar panel 87 on the back cover side of the dial, this embodiment of the invention can charge the storage cell 14 with power generated by the solar panel 87 and use this power to drive the GPS wristwatch 1B. Therefore, similarly to the first embodiment, there is no need to replace the battery as there is when a primary battery is used, and user convenience can be improved.

In addition, while the first embodiment charges by means of electromagnetic induction and therefore requires disposing a non-metallic second back cover part 112B to the back cover 112, the second embodiment uses a solar panel 87 for charging, can therefore use a metal back cover 112, and thus further improve the appearance of the GPS wristwatch 1B.

In addition, high frequency signals such as GPS satellite signals are attenuated because the solar panel 87 has a metal substrate, but because a window 87A is formed in the solar panel 87 in this embodiment of the invention, signals can pass through the window 87A and be picked up by the patch antenna 19. The patch antenna 19 can therefore receive radio signals passing through the solar panel 87, signal attenuation by the solar panel 87 can be prevented, and reception performance can be improved.

In addition, because the date window 2A in the dial 2 is formed at a position superimposed on the window 87A of the solar panel 87 in plan view, there is no need to form a separate window in the solar panel 87 to expose the date wheel 18, the light-collecting surface area can be increased compared to a configuration having an additional opening, and power generating performance can be improved.

Embodiment 3

Figure 9:
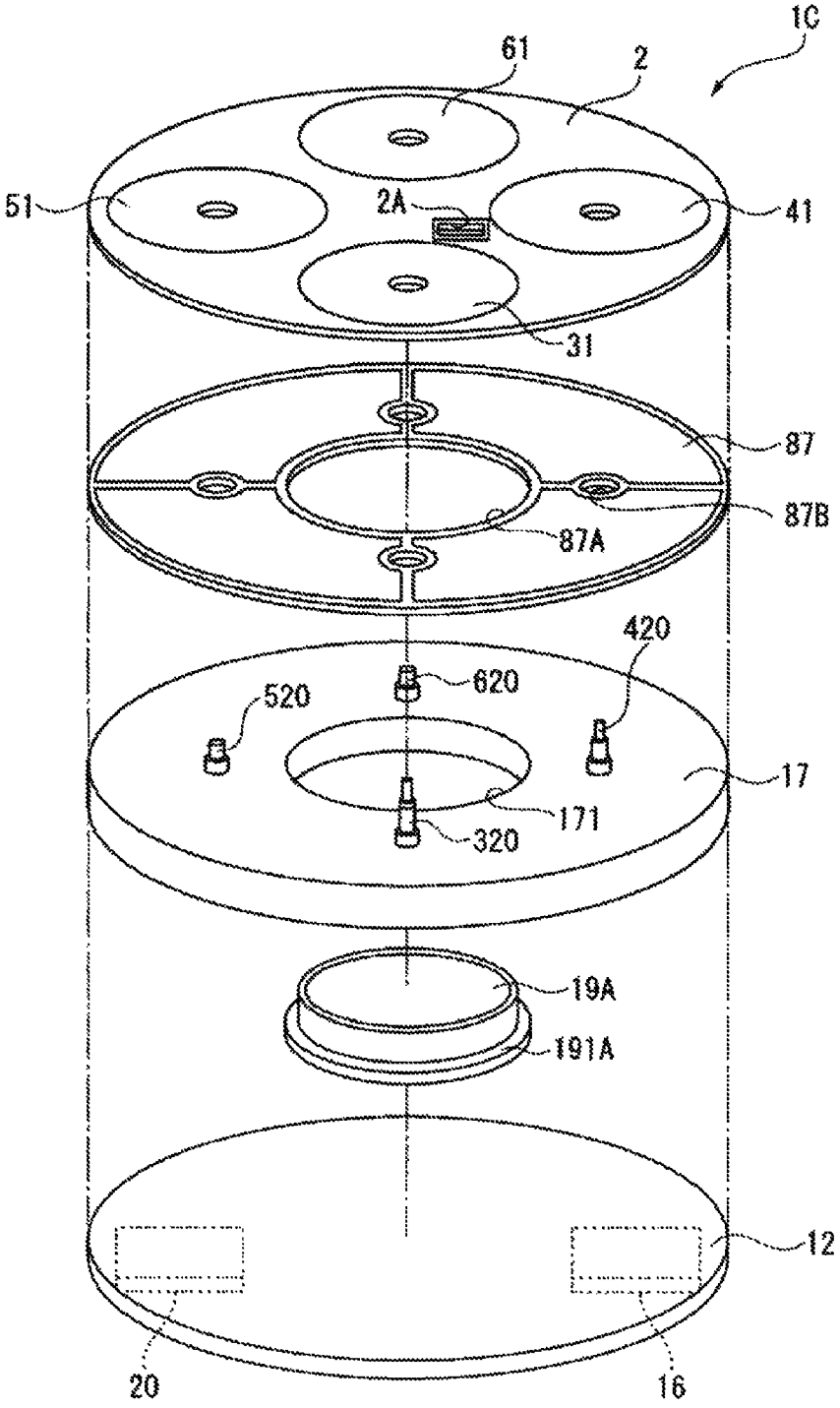
FIG. 9 is an exploded oblique view schematically showing the main parts related to a third embodiment of the invention.

FIG. 9 is an exploded oblique view showing the main parts of a GPS wristwatch 1C according to a third embodiment of the invention. Note that like parts in this embodiment and the first embodiment are identified by like reference numerals and further description thereof is omitted.

The patch antenna 19A in this embodiment of the invention is round in plan view, and thus differs in shape from the rectangular patch antenna 19 described in the first embodiment.

Note, further, that this embodiment has a solar panel 87 but can be configured without a solar panel 87.

Because the patch antenna 19A is round in plan view, the window 87A in the solar panel 87 and the opening 171 in the base plate 17 are also round conforming to the shape of the patch antenna 19A. The antenna substrate 191A is also round in plan view.

In addition to the effects of the first and second embodiments described above, the GPS wristwatch 1C according to this embodiment of the invention has the following effect.

Because the patch antenna 19A in this embodiment of the invention is round in plan view, space inside the case 11 can be used more effectively when the patch antenna 19A is housed in a case 11 that is also round in plan view than when the rectangular patch antenna 19 described in the foregoing embodiments.

Note that the resonance frequency of the round patch antenna 19A can be determined from the following equation (1). The length of one side of the rectangular patch antenna 19 used in the first and second embodiments is the half wavelength of the received signals. Therefore, when the patch antennas 19 and 19A are made of the same dielectric material, the round patch antenna 19A and the rectangular patch antenna 19 have substantially the same area.

$$f = 1.84\frac{C}{2\pi a\sqrt{\varepsilon_r}} \tag{1}$$

where f is the resonance frequency, C is the speed of light, a is the radius of the patch antenna, and Er is the dielectric constant of the dielectric material.

Because the patch antenna 19A is round in plan view in this embodiment of the invention, the specified distance L between the patch antenna 19A and the inside surface of the case member 111 can be increased compared with the first and second embodiments of the invention. As a result, the stepper motors 131 to 135 can be placed more freely. In addition, when the specified distance L is the same as in the first embodiment, the plane size of the case member 111 can be reduced and the GPS wristwatch 1C can be made smaller.

Furthermore, because the area of the window 87A can be reduced compared with the first embodiment if the size of the solar panel 87 is the same as in the first embodiment, the light-collecting surface area of the solar panel 87 can be increased accordingly, and power output can also be increased.

Embodiment 4

Figure 10:
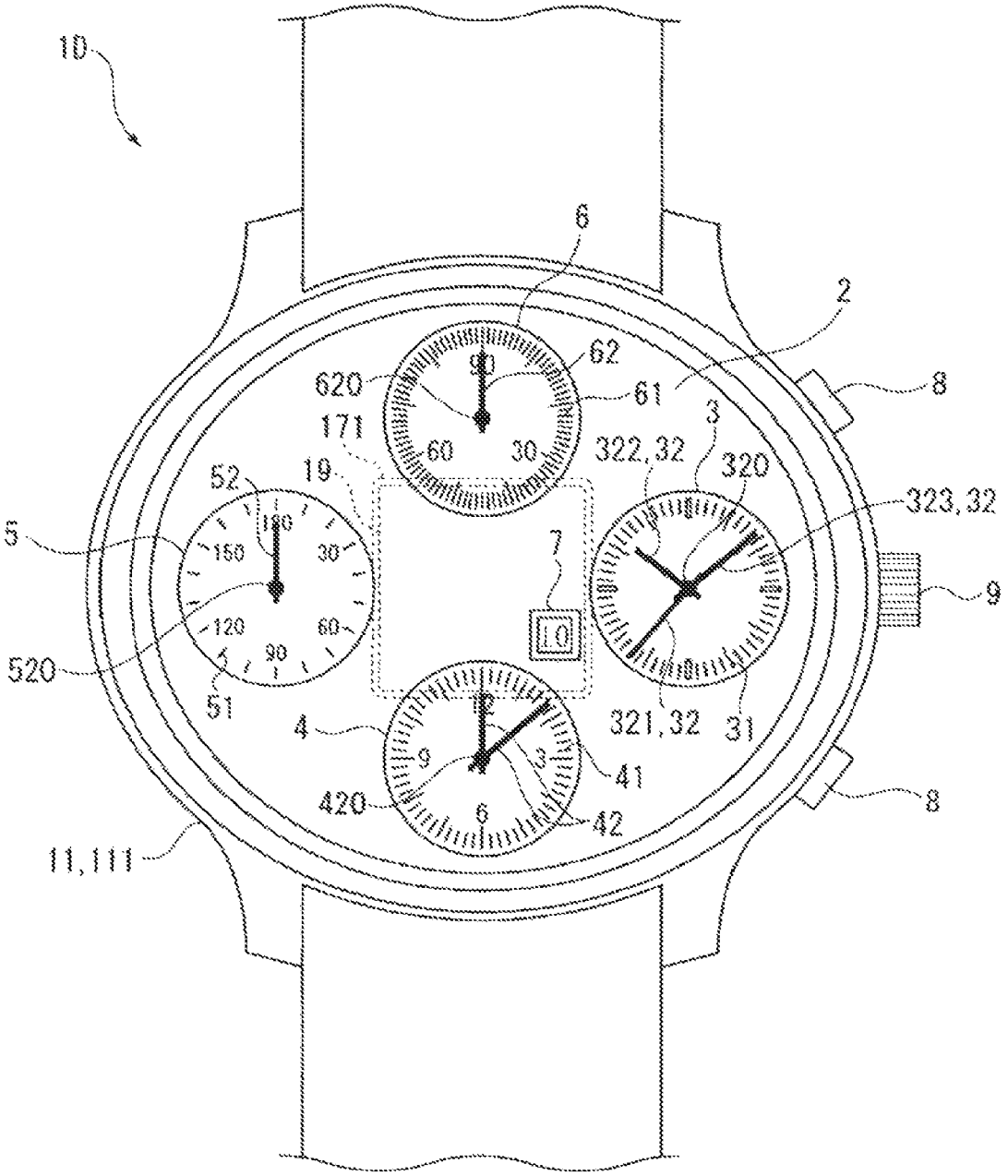
FIG. 10 is a plan view of a GPS wristwatch according to a fourth embodiment of the invention.
Figure 11:
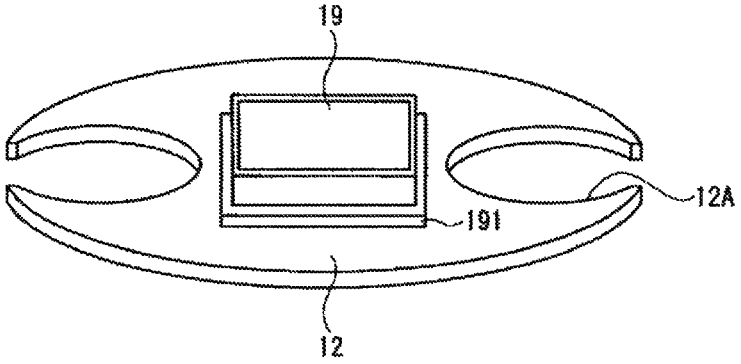
FIG. 11 is an oblique view of the circuit board according to the fourth embodiment of the invention.
Figure 12:
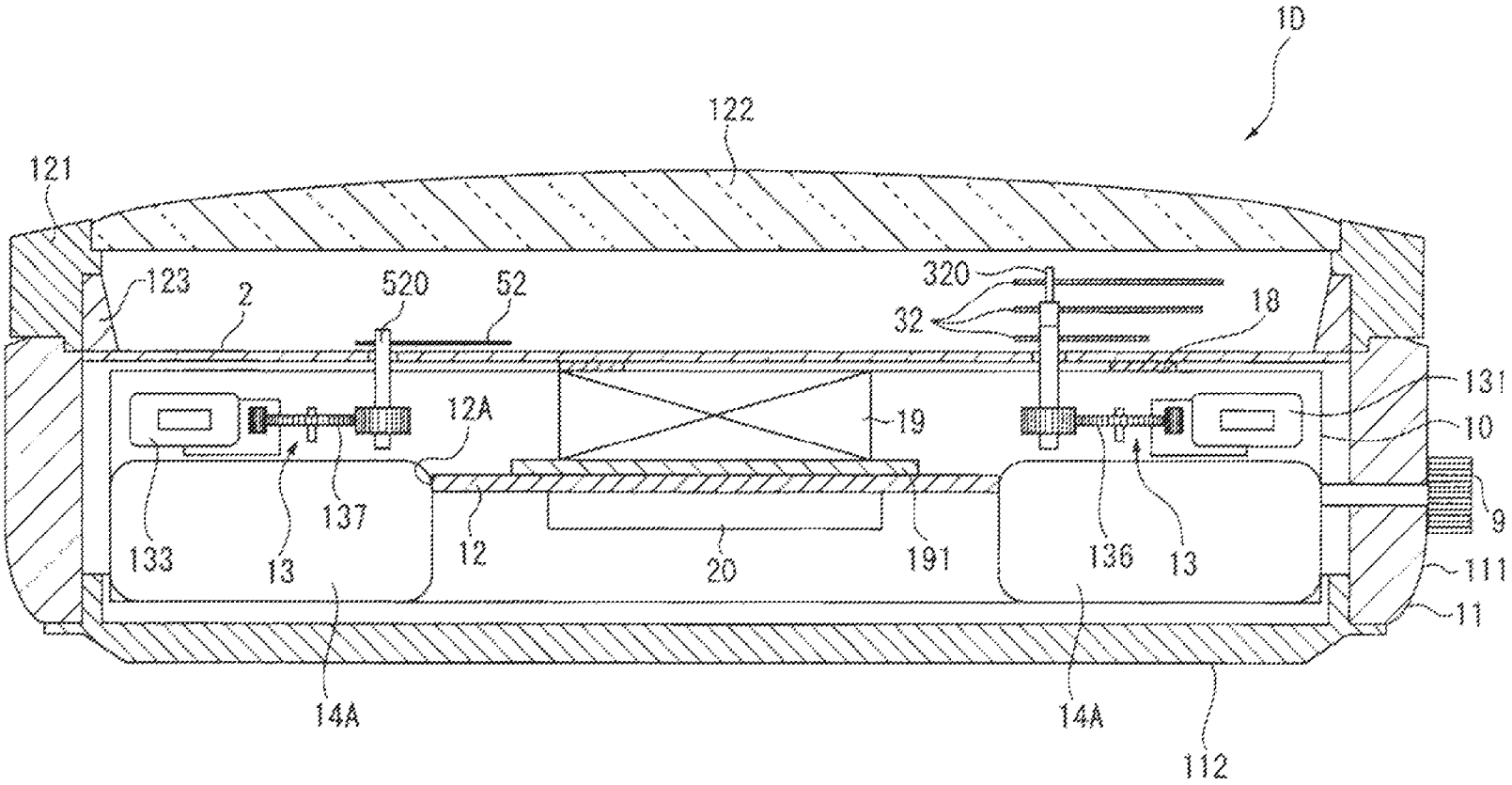
FIG. 12 is a section view of the GPS wristwatch according to the fourth embodiment of the invention.

FIG. 10 is a plan view of a GPS wristwatch 1D according to a fourth embodiment of the invention. FIG. 11 is an oblique view of the circuit board 12. FIG. 12 is a schematic section view of the GPS wristwatch 1D. Note that like parts in this embodiment and the first embodiment are identified by like reference numerals and further description thereof is omitted.

The dial 2 in the foregoing embodiments is round in plan view, but in this embodiment of the invention is an ellipse when seen in plan view. The foregoing embodiments use one storage cell 14, but this embodiment uses two batteries 14A each having a smaller diameter than the storage cell 14.

When seen in plan view, the dial 2 is an ellipse with the major axis on the left-right axis and the minor axis on the top-bottom axis as seen in FIG. 10. As a result, there is more space at the normal 3:00 and 9:00 positions of the dial 2 than at the 12:00 and 6:00 positions. By disposing the first time display unit 3 at the 3:00 position and the second time display unit 4 at 6:00 in this embodiment, the first time display unit 3 can be disposed to a position where there is no overlap with the patch antenna 19 in plan view.

The shape of the dial 2 is an ellipse in plan view, and the circuit board 12 and base plate 17 are therefore also ellipses in plan view.

Because the top-bottom diameter of the movement 10 in this embodiment of the invention is the same as the top-bottom diameter of the movement 10 in the foregoing embodiments, and the left-right diameter of the movement 10 in this embodiment of the invention is greater than the left-right diameter of the movement 10 described in the foregoing embodiments, the plane area of the movement 10 in this embodiment is greater than the plane area of the movement 10 in the foregoing embodiments.

As shown in FIG. 11, the circuit board 12 has two voids 12A large enough to insert the batteries 14A on left and right sides of the patch antenna 19. The voids 12A are formed according to the shape and size of the batteries 14A at positions corresponding to the 3:00 and 9:00 o'clock positions of the dial 2, and are formed at positions where they are not superimposed on the patch antenna 19 in plan view.

The batteries 14A in this embodiment of the invention are primary batteries. In order to ensure the same battery capacity as the storage cell 14 used in the foregoing embodiments, these batteries 14A are parallel connected and batteries 14A with a smaller size, such as a smaller diameter, than the storage cell 14 are used. The batteries 14A are disposed at 3:00 and 9:00 on the dial 2 as shown in FIG. 11 and FIG. 12 with a portion of the battery height inserted in the voids 12A in the circuit board 12.

Note that the batteries 14A in this embodiment are primary batteries, but storage cells 14 that are charged by power from a charge coil 82 or solar panel 87 may be used as in the first to third embodiments.

In addition to the effect of the first embodiment described above, the GPS wristwatch 1D according to this embodiment of the invention has the following effect.

This embodiment of the invention uses batteries 14A that each have a smaller diameter than the storage cell 14 described in the embodiments described above. As a result, a large increase in the size of the GPS wristwatch 1D can be prevented even when the patch antenna 19 and batteries 14A are disposed so that there is no overlap therebetween in plan view as in this embodiment of the invention.

Furthermore, because the patch antenna 19 and batteries 14A are disposed with no plane overlap therebetween, the thickness of the GPS wristwatch 1D can be reduced compared with a configuration in which the patch antenna 19 and batteries 14A overlap in the thickness direction.

In addition, the first time display unit 3 has three first hands 32, that is, a first second hand 321, a first hour hand 322, and a first hour hand 322, each made of metal, and has more hands than the other display units 4 to 6. Therefore, if the first time display unit 3 is disposed at a position superimposed on the patch antenna 19 in plan view, the possibility of the first hands 32 overlapping the patch antenna 19 is greater than in the other display units 4 to 6, and may possibly affect at least the reception performance of the patch antenna 19.

As a result, this embodiment of the invention uses a dial 2 that is an ellipse when seen in plan view, creating more space at 3:00 and 9:00 than at 12:00 and 6:00, and disposes the first time display unit 3 in the large space at 3:00. As a result, the first time display unit 3 can be located at a position not superimposed on the patch antenna 19 in plan view, and the first hands 32 can be prevented from affecting the reception performance of the patch antenna 19.

Embodiment 5

Figure 13:
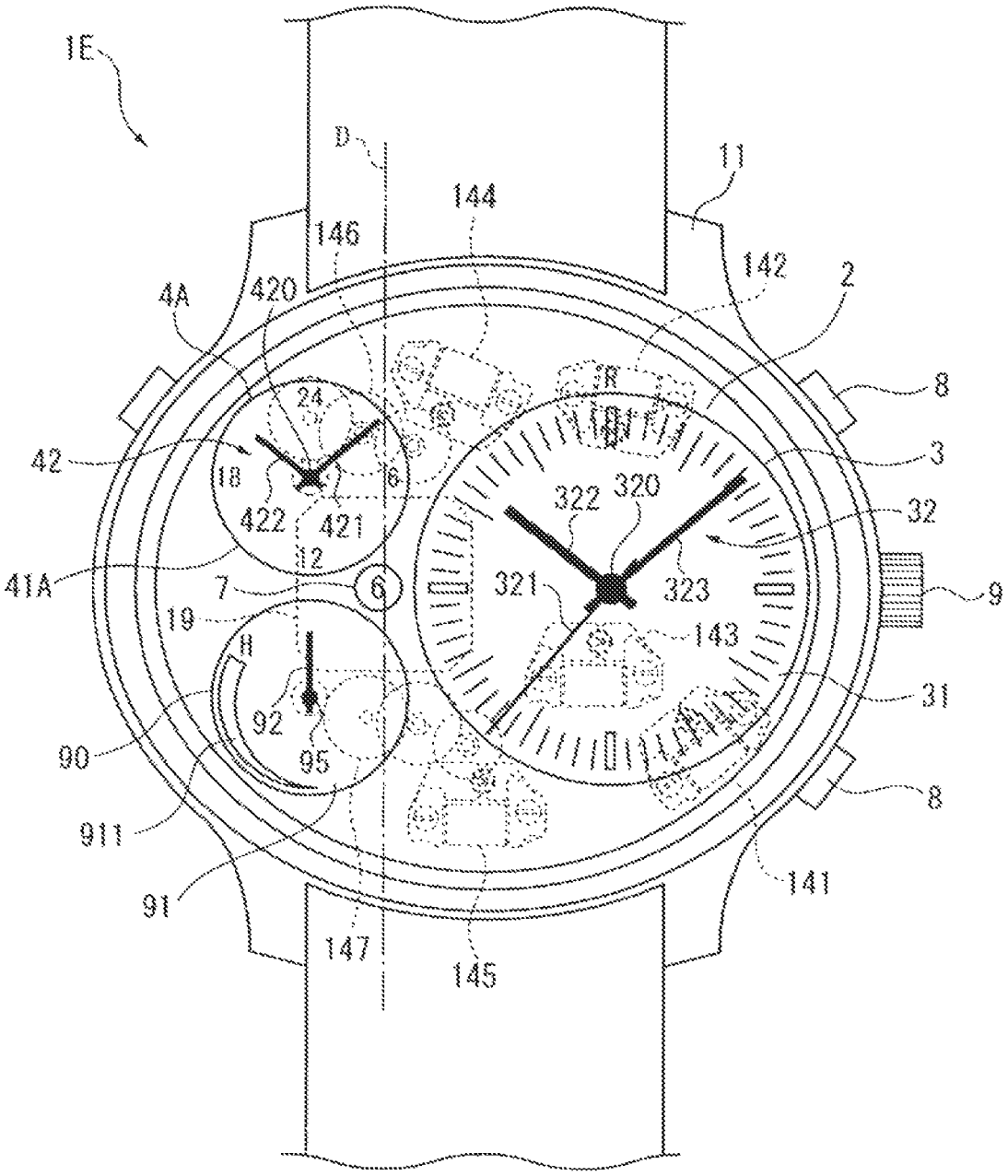
FIG. 13 is a plan view of a GPS wristwatch according to a fifth embodiment of the invention.
Figure 14:
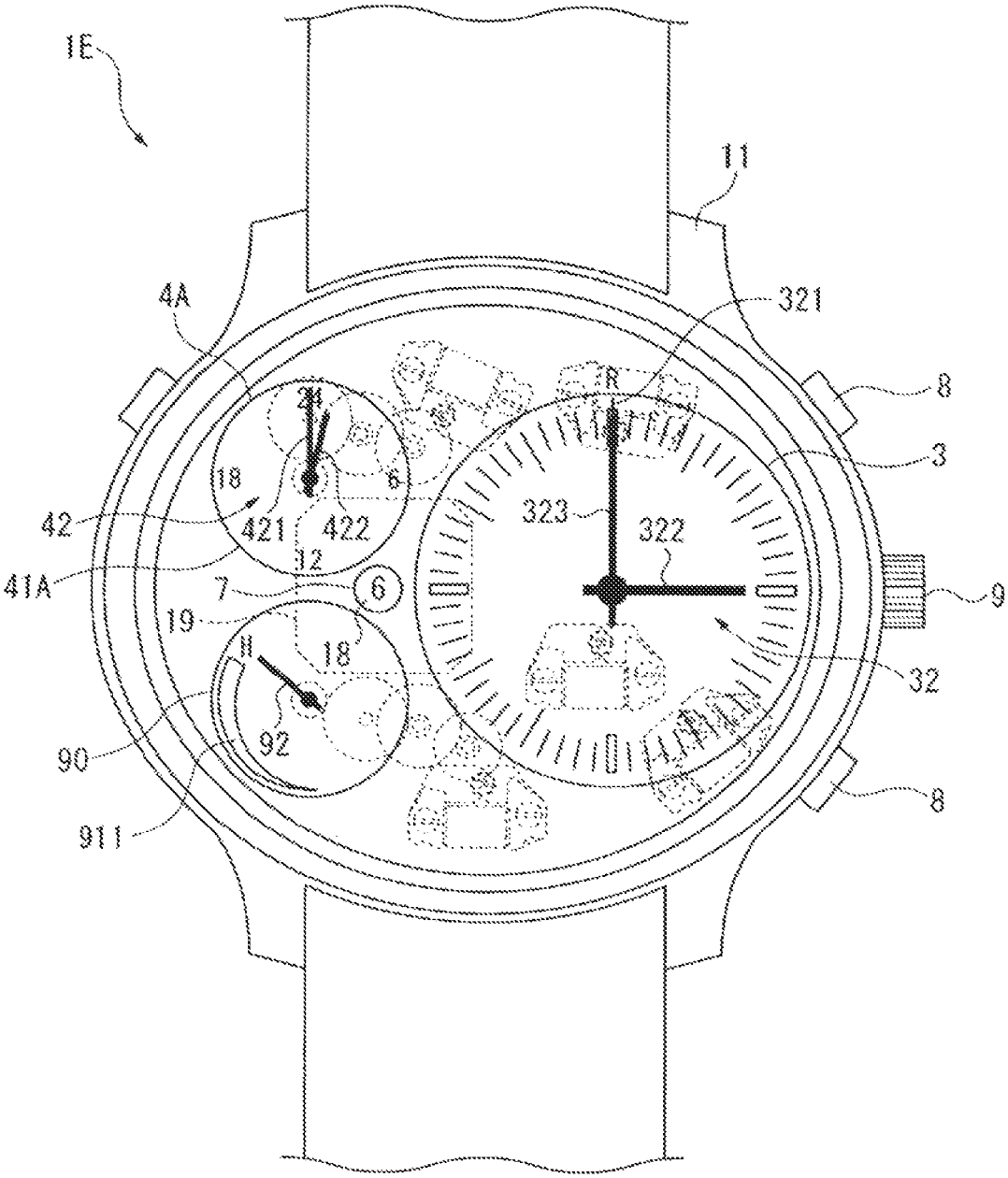
FIG. 14 is a plan view of the GPS wristwatch according to the fifth embodiment of the invention.

FIG. 13 is a plan view of a GPS wristwatch 1E according to a fifth embodiment of the invention. FIG. 14 is a plan view showing the hand positions during the reception process. Note that like parts in this embodiment and the foregoing embodiments are identified by like reference numerals and further description thereof is omitted.

As in the fourth embodiment, the dial 2 in this embodiment of the invention is an ellipse when seen in plan view with the left-right axis longer than the top-bottom axis.

A first time display unit 3 that is round in plan view is disposed as a first display unit at 3:00 (the crown 9 side) of the dial 2. A second time display unit 4A that is similarly round is disposed as a second display unit at 10:00 o'clock on the dial 2. The second hour hand 422 of the second time display unit 4A in this embodiment of the invention is a 24-hour hand that turns one revolution in 24 hours, and the chapter ring 41A is a 24-hour chapter ring.

A round mode display unit 90 is disposed as a third display unit for displaying reserve power or the signal reception level, for example, at 7:00 to 8:00 on the dial 2.

The mode display unit 90 has a calendar ring 91 for displaying the signal reception level. A graduated scale 911 that is arcuate and increases gradually in width along the direction of curvature is presented on the calendar ring 91, and the letter "H" denoting high reserve power or a high signal level is displayed at the wide end of the graduated scale 911.

The hand 92 of this mode display unit 90 is metal like the other hands 32, 42, displays reserve power except during signal reception, and displays the reception level during reception.

The display units 3 to 6 are all substantially the same size in the embodiments described above, but the first time display unit 3 is larger than the other display units in this embodiment. The first time display unit 3 occupies approximately half the area of the dial 2 so that the current time displayed on the first time display unit 3 can be read more easily.

The diameters of the other display units 4A and 90 are approximately half the size of the first time display unit 3.

The plane center of the first time display unit 3 (the position of the staff 320) and the plane centers of the second time display unit 4A and mode display unit 90 (the positions of the staffs 420 and 95) are offset to the left and right sides on the long axis (left-right direction) of the dial 2.

The plane centers of the second time display unit 4A and the mode display unit 90 (the positions of the staffs 420 and 95) are offset on the short axis (top-bottom direction) of the dial 2.

The date display unit 7 is disposed at a position surrounded by these three display units 3, 4A, and 90. The date display unit 7 has a round hole formed in the dial 2 and a plastic date wheel 18 that is disposed below the dial 2 and exposed through this hole. The patch antenna 19 is located below the round hole in the date display unit 7.

The patch antenna 19 is disposed at a position with part thereof superimposed on the display units 3, 4A, and 90 in plan view. The patch antenna 19 is also disposed at a position not overlapping the staff 320 of the first hands 32, the staff 420 of the second hands 42, or the staff 95 of the hand 92 in plan view.

More specifically, the patch antenna 19 is disposed between the staff 420 and staff 95 in the direction of a line connecting the staff 420 and staff 95 (the short axis of the dial 2).

The patch antenna 19 is also disposed between the staff 420 and staff 320 in the direction of a line connecting the staff 420 and staff 320.

The patch antenna 19 is also disposed between the staff 320 and the staff 95 in the direction of a line connecting the staff 320 and staff 95.

On the long axis of the dial 2, the patch antenna 19 is thus disposed offset from staff 320 to the side of staffs 95 and 420.

That the patch antenna 19 is located between the staffs as described above means that part of the patch antenna 19 is disposed on an axis connecting two staffs. In this configuration the patch antenna 19 is preferably disposed between two lines that are perpendicular to a line through the two staffs and pass respectively through the two staffs. For example, that the patch antenna 19 is located between staff 420 and staff 95 means that part of the patch antenna 19 is superimposed on a line connecting staff 420 and staff 95. The patch antenna 19 is also preferably disposed between two lines that are perpendicular to the line through staff 420 and staff 95 and respectively pass through the staffs 420 and 95.

A stepper motor 141 that drives the first hour hand 322 and first minute hand 323 of the first time display unit 3, a stepper motor 142 that drives the first second hand 321, a stepper motor 143 that drives the date wheel 18, a stepper motor 144 that drives the second hour hand 422 and second minute hand 421 of the second time display unit 4A, and a stepper motor 145 that drives the hand 92 of the mode display unit 90 are disposed below the dial 2.

These stepper motors 141 to 145 are identical to the stepper motors 131 to 135 in the foregoing embodiments, and further description thereof is thus omitted.

As shown in FIG. 13, these stepper motors 141 to 145 are disposed in one of two plane areas into which the dial 2 is divided by an imaginary line D passing through the center of the patch antenna 19.

Drive power from stepper motor 144 is transmitted through wheel train 146 to the staff 420 and drives the second minute hand 421 and second hour hand 422. Drive power from the stepper motor 145 is similarly transferred through wheel train 147 to the staff 95 and drives the hand 92. These wheel trains 146 and 147 are, like staffs 420 and 95, disposed between the patch antenna 19 and the inside surface of the case 11.

The other stepper motors 141 to 143 likewise drive the first hour hand 322, first minute hand 323, first second hand 321, and date wheel 18 through wheel trains not shown, and these wheel trains are also disposed between the patch antenna 19 and the inside surface of the case 11.

The imaginary line D in this embodiment of the invention is set along the 12:00-6:00 axis of the dial 2 (in line with the wristband). The center of the patch antenna 19 is also offset from the plane center of the dial 2 to the 9:00 side (the opposite side as the side where the crown 9 is located).

As a result, when the dial 2 is divided into two parts in plan view by imaginary line D, the area on the 3:00 o'clock side of the imaginary line D is larger than the area on the 9:00 o'clock side. The stepper motors 141 to 145 are located in this part with the larger area.

The stepper motors 141 to 145 are not disposed in the area on the 9:00 o'clock side of the imaginary line D. As shown in FIG. 4 in the first embodiment, the stepper motors 131 to 135 are disposed around the patch antenna 19, and the patch antenna 19 is nearly completely surrounded by the stepper motors 131 to 135. In this embodiment as shown in FIG. 13, however, the stepper motors 141 to 145 are not disposed in nearly half of the area around the patch antenna 19, and the stepper motors 141 to 145 do not completely surround the patch antenna 19.

As a result, radio waves from the 9:00 o'clock side of the dial 2 in this GPS wristwatch 1E can be received by the patch antenna 19 without being affected by the stepper motors 141 to 145.

The same movements and batteries described in the foregoing embodiments can also be used in this embodiment. The battery may be a primary battery, or a storage cell 14 that is charged by a charging coil or solar panel may be used as described in the first to third embodiments.

The GPS wristwatch 1E according to the fifth embodiment of the invention has a dual time display mechanism that can display the time in two regions in different time zones by means of the first time display unit 3 and second time display unit 4A.

For example, the first time display unit 3 can be used as a standard clock that displays the current time while using the second time display unit 4A to display the time in another preset time zone. In FIG. 13 and FIG. 14 the first time display unit 3 displays Japan Standard Time (JST), which is a time zone where the time is Universal Coordinated Time (UTC) +9 hours, and the second time display unit 4A displays the time in a time zone (such as Thailand) where the time is UTC +7 hours. In the example shown in FIG. 13, the first time display unit 3 with a 12-hour calendar ring shows a time of approximately 10:8:37 p.m., and the second time display unit 4A with a 24-hour calendar ring shows a time of 20:08 (08:08) p.m.

The reception operation in this embodiment of the invention is described next.

Similarly to the foregoing embodiments, the GPS wristwatch 1E has a scheduled reception mechanism (automatic reception mechanism) that executes the reception process at a predetermined time, and a manual reception mechanism that executes the reception process when the user presses a button.

More specifically, the control unit 16 of the GPS wristwatch 1E has a scheduled reception mechanism that starts reception when the internal time reaches a specified scheduled time. The internal time is kept by the RTC 16A shown in FIG. 6.

The scheduled reception mechanism is controlled to start the scheduled reception at a time when the hands 32 and 42 that display the time are not over the area of the patch antenna 19 in plan view.

More specifically, the control unit 16 checks the time difference between the first hands 32 of the first time display unit 3 and the second hands 42 of the second time display unit 4A, and starts scheduled reception at a time that is preset according to the time difference.

For example, when the first hour hand 322 of the first time display unit 3 is in the area of 8:00-10:00, and when the first hour hand 322 is in the area of 40-50 minutes, one of the hands 322 and 323 may be over the patch antenna 19 when seen in plan view. The scheduled reception time is therefore a time when the first hour hand 322 is outside the 8:00-10:00 range, and when the first hour hand 322 is outside the area of 40-50 minutes. More specifically, the scheduled reception time is set to a time when the first hour hand 322 is in the range from 0 (12:00) to 8:00 (20:00), or is in the range from 10:00 (22:00) to 12:00 (24:00), and the first minute hand 323 is in the range from 0-40 minutes or 50-60 minutes.

One of the hands 421 and 422 may also overlap the patch antenna 19 in plan view when the second hour hand 422 of the second time display unit 4A is in the range from 6:00-12:00, and when the second minute hand 421 is in the range from 15-30 minutes. The scheduled reception time is therefore a time when the second hour hand 422 is outside the range from 6:00-12:00, and the second minute hand 421 is outside the range from 15-30 minutes. More specifically, the scheduled reception time is set to a time when the second hour hand 422 points to the range from 0:00-6:00 or from 12:00-24:00, and the second minute hand 421 points to the range from 0-15 minutes or the range from 30-60 minutes.

The control unit 16 sets the scheduled reception time to a range in which the first hands 32 and the second hands 42 satisfy the foregoing conditions. Because the times when these conditions are satisfied differs according to the difference between the times indicated by the first time display unit 3 and the second time display unit 4A, the control unit 16 starts scheduled reception at a time that is set according to the time difference. In the example shown in FIG. 14 the time indicated by the second time display unit 4A is −2 hours from the time indicated by the first time display unit 3. As a result, if reception is set to start when the first time display unit 3 indicates 3:00 a.m. and the second time display unit 4 indicates 1:00 a.m., for example, the reception operation can be executed when the hands 32 and 42 do not overlap the patch antenna 19 in plan view.

During reception the first second hand 321 moves to the reception display position (a position at 12:00 on the chapter ring 31) and stops. A marker "R" denotes this reception display position on the dial 2. As a result, the first second hand 321 will not move to a position overlapping the patch antenna 19 in plan view while reception is in progress.

Hand 92 will also not move to a position overlapping the patch antenna 19 in plan view during reception because it displays the reception level in the area where the graduated scale 911 and "H" are displayed. This movement of the first second hand 321 and hand 92 is controlled by the drive circuit 130, which is a motor drive control means.

Because the scheduled reception time is executed when these conditions are met, signals can be received when the hands 32, 42, and 92 are not located over the patch antenna 19.

In the manual reception process, however, the reception process executes when the user presses a button. The hand 92 is also moved by the drive circuit 130 and displays the reception level in this situation, and is therefore not located above the patch antenna 19. The first second hand 321 is also moved to the receiving display position by the drive circuit 130 and stops.

The first hour hand 322, first minute hand 323, second hour hand 422, and second minute hand 421, however, are not moved in conjunction with the reception process. As a result, the user preferably starts reception manually at a time when these hands 322, 323, 421, 422 are not located over the patch antenna 19.

When signals are received from the GPS satellite S and positioning data and time data are received, the control unit 16 adjusts the time displayed by the first time display unit 3 based on this information and also adjusts the time displayed by the second time display unit 4A accordingly.

In addition to the effects of the embodiments described above, this embodiment of the invention also has the following effect.

In the area around the patch antenna 19, the stepper motors 141 to 145 are disposed on only one side of an imaginary line D. As a result, when the patch antenna 19 receives satellite signals from the area on the other side of the line, signals can be received without being affected by the stepper motors 141 to 145, and reception sensitivity can be improved.

Furthermore, because the patch antenna 19 is located offset to the 9:00 side from the plane center of the dial 2 in this embodiment, the area of the region on the 3:00 side of the imaginary line D can be increased.

As a result, the area in which the stepper motors 141 to 145 are disposed can be increased, and five motors can be used as described in this embodiment. A timepiece with multiple subdials (timepiece with multiple staffs) having a plurality of staffs can thus be easily rendered.

Furthermore, because the size of the first time display unit 3 is larger than the other display units 4A and 90, the time at the current location displayed by the first time display unit 3 can be easily read and usability can be improved.

The patch antenna 19 is located between the hand staffs 320, 420, 95. As a result, the patch antenna 19 can be disposed at least a specified distance from the inside surface of the case 11. More specifically, the patch antenna 19 can be separated from the inside surface of the case 11 at least an amount that is the minimum distance between the staffs 320, 420, 95 and the inside surface of the case 11.

As a result, the effect of a metal case 11 on reception of satellite signals by the patch antenna 19 can be reduced.

Furthermore, because the staffs 320, 420, 95 and wheel trains 146, 147 can be located in the space between the patch antenna 19 and case 11, this space can be used effectively and the timepiece can be made thinner than a configuration in which the antenna 19 and wheel trains 146, 147 overlap each other in the thickness direction of the timepiece.

In addition, the patch antenna 19 is superimposed in plan view on the three display units 3, 4A, 90. As a result, the area in which these display units 3, 4A, 90 and the patch antenna 19 overlap in plan view can be reduced compared with a configuration in which the patch antenna 19 is disposed straddling only two display units.

The area in which the hands 32, 42, 92 can be disposed without overlapping the patch antenna 19 in plan view is therefore larger, and the scheduled reception process can be easily executed at a time when the hands 32, 42 that display the time are not superimposed on the patch antenna 19.

The mode display unit 90 displays the remaining battery capacity during normal operation of the movement, and displays the reception level during signal reception. As a result, the user can easily know the remaining battery capacity and the reception level from the mode display unit 90.

Embodiment 6

Figure 15:
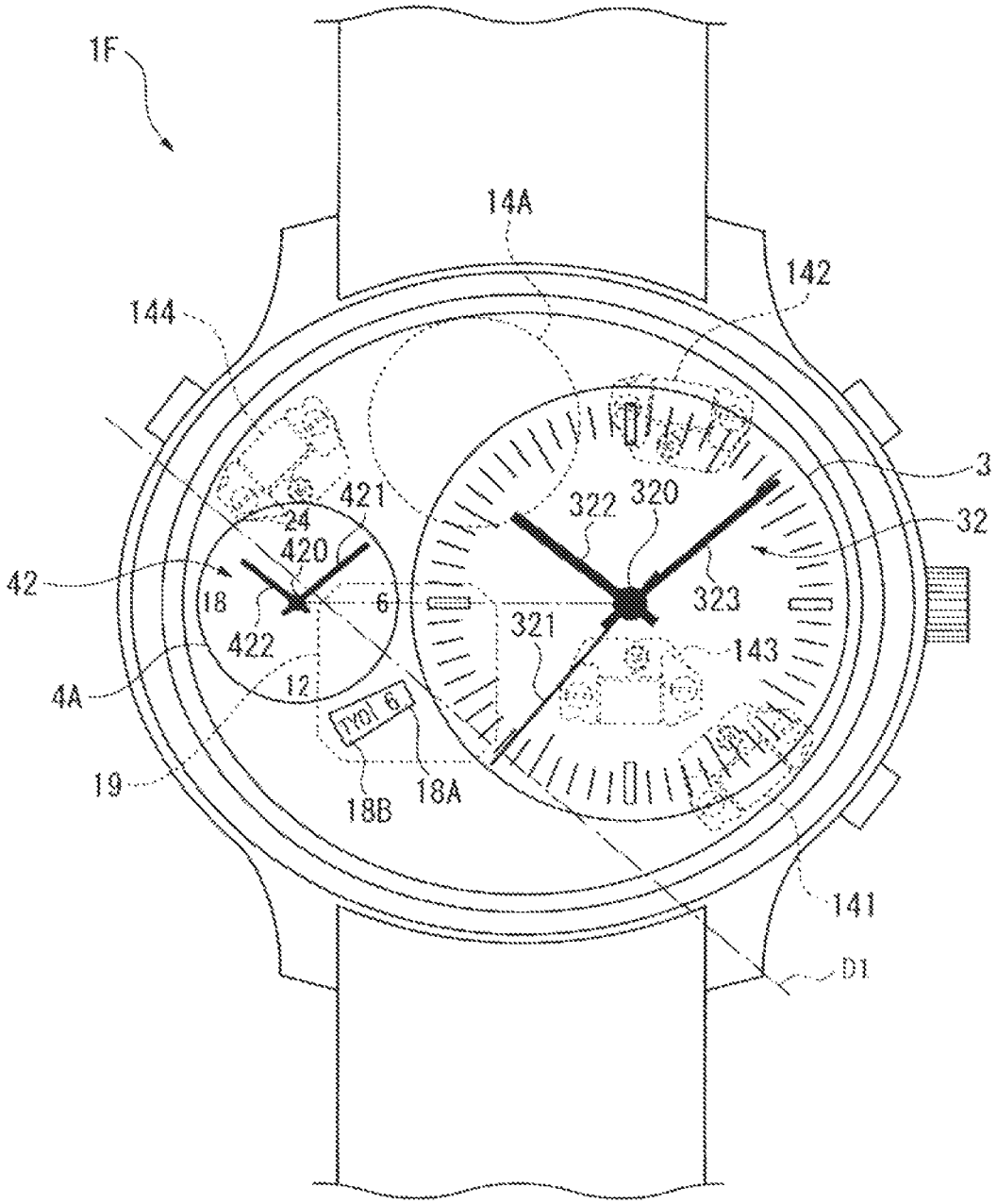
FIG. 15 is a plan view of a GPS wristwatch according to a sixth embodiment of the invention.

FIG. 15 is a plan view of a GPS wristwatch 1F according to a sixth embodiment of the invention. Note that like parts in this sixth embodiment and the foregoing embodiments are identified by like reference numerals and further description thereof is omitted.

This GPS wristwatch 1F has a first time display unit 3 and a second time display unit 4A that is smaller than the first time display unit 3 similarly to the GPS wristwatch 1E according to the fifth embodiment of the invention, but differs therefrom by not having a mode display unit 90. As a result, the first time display unit 3 and second time display unit 4A are disposed on the left and right sides of the dial 2 as shown in FIG. 15, and the staffs 320 and 420 of the hands 32 and 42 are disposed on a line connecting 3:00 and 9:00 on the dial 2.

A battery 14A is disposed on the back side of the dial 2 at a plane position near 12:00 on the dial 2.

Further similarly to the GPS wristwatch 1E, stepping motors 141-144 drive the hands and date wheel.

In this GPS wristwatch 1F the patch antenna 19 is disposed in an area superimposed on the dial 2 in plan view and between the staff 420 and staff 320 in the direction of a line connecting the staff 420 and staff 320.

More specifically, the patch antenna 19 is disposed between two imaginary lines that pass through the staffs 320 and 420 and are perpendicular to an imaginary line connecting staff 320 and staff 420.

In addition, part of the patch antenna 19 is disposed at a position superimposed in plan view on the display units 3 and 4A. The area of the part where the patch antenna 19 and display units 3, 4A overlap each other in plan view decreases as the position where the patch antenna 19 is located moves perpendicularly away from a line passing through the staffs 320 and 420.

However, the patch antenna 19 also moves closer to the inside surface of the case 11 with movement in this direction.

Therefore, the location of the patch antenna 19 may be determined with consideration for the distance to the inside surface of the case 11 and the area of plane overlap with the display units 3 and 4A. More specifically, the distance between the patch antenna 19 and the inside surface of the case 11 is preferably as large as possible to prevent a drop in reception sensitivity, and this area of overlap is preferably as small as possible to more easily prevent the hands 32 and 42 from overlapping the patch antenna 19 during scheduled reception operations. As also shown in the figure, increasing the distance between the patch antenna 19 and case 11 also increases this area of overlap. The location of the patch antenna 19 is therefore preferably determined with consideration for these factors.

A display window is also rendered in the part of the dial 2 where the patch antenna 19 is located. A large and a small display ring are exposed in this display window.

The inside ring 18A is a date wheel that displays the current date in the window.

The outside ring 18B is a ring that displays the names of cities representing the time zone of the time displayed by the second time display unit 4A. In FIG. 15 "TYO" denoting Tokyo is displayed to indicate the time zone of the time displayed by the second time display unit 4A.

Note that in this embodiment of the invention the two rings 18A and 18B are driven rotationally by a stepper motor 143. More specifically, when the rotor of the stepper motor 143 moves in a specific first direction, the inside ring 18A rotates in the direction advancing the displayed date.

When the rotor of the stepper motor 143 moves in a second direction opposite the first direction, the outside ring 18B turns in a specified single direction.

More specifically, by changing the direction of stepper motor 143 rotation, the inside and outside rings 18A and 18B can rotate individually.

Note that a configuration that has another stepper motor and drives the rings 18A and 18B with different motors is also conceivable.

When the plane area of the dial 2 is divided into two sections by an imaginary line D1 that passes through the plane center of the patch antenna 19 and through the top left corner and bottom right corner of the patch antenna 19 as seen in FIG. 15, the stepper motors 141-144 are also disposed in this embodiment of the invention in the part with the larger area.

As in the GPS wristwatch 1E described above, the scheduled reception process is executed in this embodiment at a time when the hands 32 and 42 of the display units 3 and 4A do not overlap the patch antenna 19. The first second hand 321 moves to the 12:00 position and stops at this time.

When reception is started manually, the first second hand 321 moves to the 12:00 position and stops during reception.

This embodiment of the invention has the same operating effect as the foregoing embodiments. More particularly, this embodiment has the same operating effect as the GPS wristwatch 1E according to the fifth embodiment of the invention.

Other Embodiments

The invention is not limited to the embodiments described above, and variations and improvements that can achieve the object of the invention are included in the scope of this invention.

GPS wristwatches 1A to 1F are used as an example of a timepiece in the embodiments described above, but the invention can also be applied to pocket watches and other types of timepieces.

In the foregoing first to fourth embodiments the patch antenna 19 is located in the plane center of the dial 2, but the location of the patch antenna 19 can be offset as described in the fifth and sixth embodiments and is not limited to the plane center insofar as the distance L between the outside surface of the patch antenna 19 and the inside surface of the case member 111 is at least a specified size.

An example of such a patch antenna 19 location is described below with reference to FIG. 16 and FIG. 17.

Figure 16:
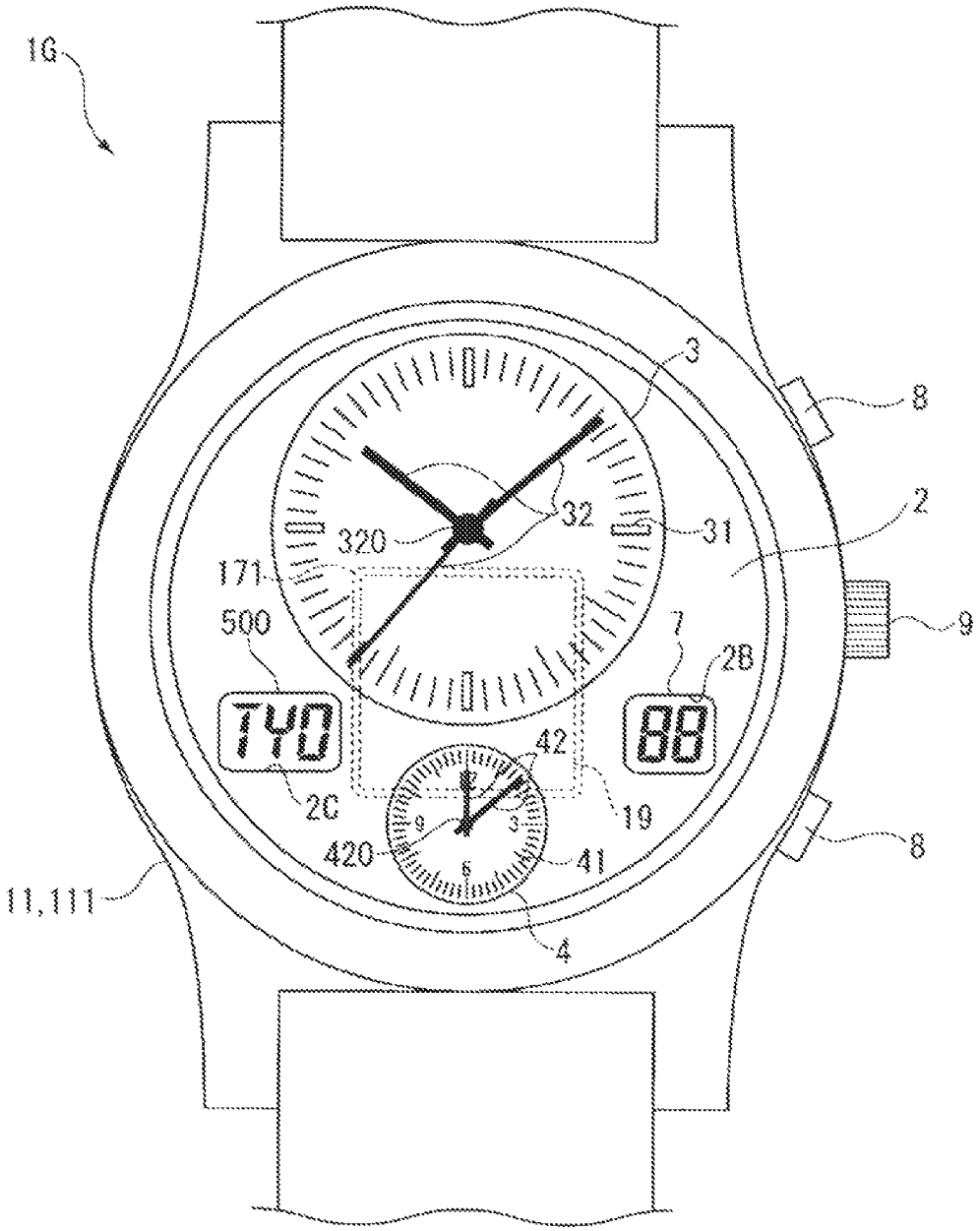
FIG. 16 is a plan view of a GPS wristwatch according to another embodiment of the invention.
Figure 17:
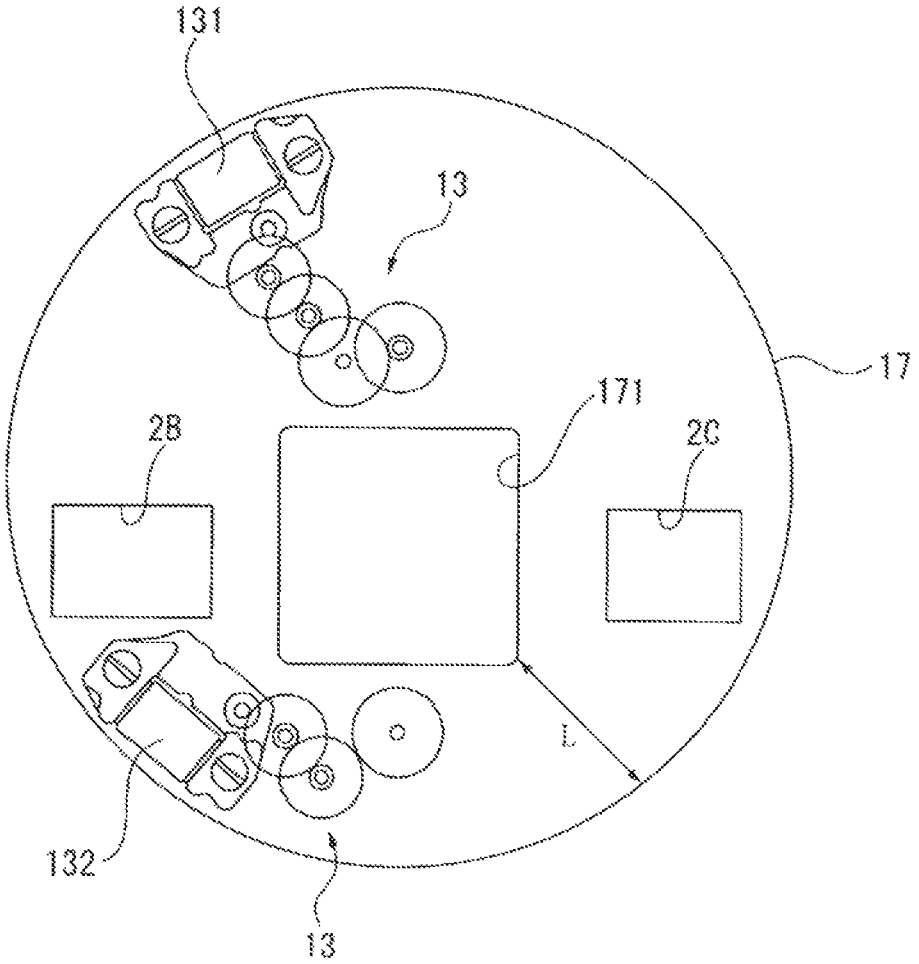
FIG. 17 is a back side view of the movement assembled into a GPS wristwatch according to the other embodiment of the invention.

FIG. 16 is a plan view of a GPS wristwatch 1G as an example of a variation of the GPS wristwatch 1A according to the first embodiment of the invention, and FIG. 17 shows the back of the movement 10 in this variation. Note that like parts in this embodiment and the first embodiment are identified by like reference numerals and further description thereof is omitted.

This GPS wristwatch 1G has a first time display unit 3 at 12:00, a second time display unit 4 at 6:00, a current location display unit 500 near 7:00-8:00, and a date display unit 7 near 4:00-5:00. The current location display unit 500 and date display unit 7 are digital displays rendered by LCD panels, and the LCD panels are exposed and display through windows 2B and 2C formed in the dial 2. The current location display unit 500 in this example displays "TYO" denoting Tokyo.

Because only the first and second time display units 3 and 4 are analog displays, two stepper motors 131 and 132 are disposed between the outside surface of the patch antenna 19 and the inside surface of the case member 111 as shown in FIG. 17. The hands 32 and 42 on the staffs 320 and 420 that pass through the center of the first and second time display units 3 and 4 are driven by stepper motors 131 and 132.

As shown in FIG. 17, the first time display unit 3 is larger than in the first embodiment so that the user can easily read the current time. Because the position of the staff 320 inserted to the first time display unit 3 is near the plane center of the GPS wristwatch 1G, the staff 320 and the patch antenna 19 could overlap in plan view, and the patch antenna 19 therefore cannot be disposed in the plane center as described in the embodiments described above. As a result, the patch antenna 19 is disposed offset from the plane center toward 6:00. In this configuration the distance L is set so that the outside surface of the patch antenna 19 and the inside surface of the case member 111 are separated by at least a specified distance.

The circuit board 12 also functions as a ground plate in the embodiments described above, but a separate ground plate that functions only as a ground plate may be used.

In the foregoing embodiments distance L is set so that stepper motors 131 to 135 can be incorporated, but may be set to a distance that will not accommodate stepper motors 131 to 135. In this configuration the stepper motors 131 to 135 may be disposed to a location with a dimension that is greater than distance L between the outside surface of the patch antenna 19 and the inside surface of the case member 111.

In the first to third embodiments the date window 2A is located offset toward 4:00-5:00 from the center of the dial 2, but the invention is not so limited and the date window 2A may be rendered at a position moved to the outside from the opening 171. However, when the solar panel 87 is located above the date wheel 18, an opening must be formed in the solar panel 87 so that the date can be read from the outside. Therefore, when a solar panel 87 is used the date window 2A is preferably formed at any position within the range overlapping the opening 171 in plan view.

The patch antenna 19 is rectangular in plan view in the fourth to sixth embodiments, but may be round as in the third embodiment.

In the fourth embodiment voids 12A are formed in the circuit board 12 according to the shape of the batteries 14A, but the size of the circuit board 12 may be reduced and the batteries 14A disposed to a position not superimposed on the patch antenna 19 in plan view.

Furthermore, the fourth embodiment has a second time display unit 4 with two hands disposed at 6:00 on the dial 2 of a common timepiece, but the second time display unit 4 may be disposed at 9:00 on the dial 2 of a common timepiece with the longitude display unit 5 disposed at 6:00. Because the second time display unit 4 with two hands can be disposed to a position where there is no plane overlap with the patch antenna 19 in this configuration, the second hands 42 can be more effectively prevented from interfering with the reception performance of the patch antenna 19.

The fourth to sixth embodiments shown in FIG. 10 to FIG. 15 are configured so that the direction aligned with the wristband of the timepiece (the direction through 12:00 and 6:00 on the chapter ring 31 of the timepiece) is the minor axis of the dial 2, but a configuration in which the direction of the timepiece band is aligned with the major axis of the dial 2 is also conceivable. In this configuration, because the dial 2 is an ellipse, the first time display unit 3 in the fifth embodiment may be disposed on the 12:00 side of the dial 2, and the second time display unit 4A and the mode display unit 90 may be disposed at the 6:00 side of the dial 2.

The plane shape of the dial 2 in the fourth to sixth embodiments is also not limited to an ellipse, and may be a rectangle, a shape combining a rectangle and a semicircle, a shape combining a rectangle and a half ellipse, or various other shapes. More specifically, the shape of the dial 2 can be determined according to the design of the timepiece.

The hand staffs in the foregoing embodiments are located between the patch antenna 19, 19A and the case 11, but a through-hole may be formed in the patch antenna and part of the hand staffs may be disposed passing through this through-hole. For example, if the patch antenna is disposed in the center of the timepiece, a 3-hand center display may be rendered by forming a through-hole through which a staff passes in the center of the patch antenna, and disposing a first time display unit with an hour hand, minute hand, and second hand attached to this staff to display the current time.

With this configuration the staff and hands can be located in the plane center of the dial even when the patch antenna is also located in the plane center of the dial. In addition, because the other staffs can be located between the antenna and case, hands for displaying the time in a different time zone, reserve power, or other information can be disposed around the antenna. The layout of the hands used in a GPS wristwatch can therefore be varied in many ways, and GPS wristwatches with fashionable designs can be achieved.

Furthermore, while a through-hole will be formed in the center of the patch antenna with this configuration, the effect of a center through-hole on antenna performance can be reduced while maintaining reception performance even though a through-hole is formed in the center because impedance is low in the center, and a layout similar to a common analog timepiece is thus possible.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The invention is also not limited to receiving RF satellite signals from such positioning information satellites, and may be used as a short-range wireless receiver for circularly polarized wireless tags operating in the 900 MHz frequency band, for example.

Yet further, the invention is not limited to receiving circularly polarized waves, and can be used to receive linearly polarized waves.

Furthermore, when an inverted-F antenna is used as the patch antenna, the invention can also be used in short-range wireless communication devices such as wireless LAN and Bluetooth (R) receivers. Furthermore, the foregoing embodiments are described primarily with reference to the reception function because they are used as GPS receivers, but the device having an internal antenna according to the invention is not so limited and the invention can obviously also be used in a transmission and reception function.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A timepiece, comprising:

a case;

a dial that is made from a nonconductive material;

a solar panel that has an opening and is disposed at a side opposite of a display side of the dial, the solar panel receiving light incident from the display side of the dial;

a patch antenna that is disposed (i) at a side opposite of a light receiving side of the solar panel, and (ii) at a position overlapping the opening in plan view; and a date wheel made from nonconductive material that is disposed between the solar panel and the patch antenna in lateral view, and is disposed at a position overlapping, at least in part, the patch antenna in plan view;

wherein the dial has a date window for exposing at least part of the date wheel; and wherein the date window is formed at a position overlapping the opening in plan view.

2. The timepiece described in claim 1, wherein:

the patch antenna includes a dielectric and an electrode formed on the dielectric.

3. The timepiece described in claim 1, wherein:

a size of the opening is set to be the same as a plane area of the patch antenna.

4. The timepiece described in claim 1, wherein:
the patch antenna is an inverted-F antenna.

5. The timepiece described in claim 1, wherein:
the patch antenna is a chip antenna rendering an inverted-F antenna on a ceramic dielectric package.

6. The timepiece described in claim 1, further comprising:
a receiver unit that processes signals received by the patch antenna; and
a storage cell that is charged with power generated by the solar panel;
wherein the receiver unit is disposed where it does not overlap the storage cell in plan view.

7. The timepiece described in claim 1, wherein:
the solar panel includes four solar cells.

8. The timepiece described in claim 1, further comprising:
a receiver unit that processes signals received by the patch antenna; and
an operating button that is manually operated by a user;
wherein the receiver unit processes signals when the operating button is operated.

9. The timepiece described in claim 1, further comprising:
a receiver unit that processes signals received by the patch antenna; and
a control unit that keeps an internal time;
wherein the receiver unit processes signals when the internal time kept by the control unit reaches a preset scheduled reception time.

10. The timepiece described in claim 1, further comprising:
a receiver unit that processes signals received by the patch antenna and outputs positioning information;
a control unit that keeps an internal time; and
a storage unit that stores time difference data;
wherein the control unit calculates a local time based on the positioning information, the internal time, and the time difference data.

11. The timepiece described in claim 1, wherein:
the timepiece is a wristwatch.

* * * * *